US012533565B2

(12) United States Patent
Nielsen et al.

(10) Patent No.: US 12,533,565 B2
(45) Date of Patent: Jan. 27, 2026

(54) DEVICES, SYSTEMS, AND METHODS FOR EXERCISE DEVICE CONTROL

(71) Applicant: iFIT Inc., Logan, UT (US)

(72) Inventors: Rebecca Lynn Nielsen, Logan, UT (US); Jessie Dent, Logan, UT (US)

( * ) Notice: Subject to any disclaimer, the term of this patent is extended or adjusted under 35 U.S.C. 154(b) by 91 days.

(21) Appl. No.: 18/660,217

(22) Filed: May 9, 2024

(65) Prior Publication Data

US 2025/0345691 A1 Nov. 13, 2025

(51) Int. Cl.
*A63B 71/06* (2006.01)
*A63B 24/00* (2006.01)

(52) U.S. Cl.
CPC ..... *A63B 71/0622* (2013.01); *A63B 24/0075* (2013.01); *A63B 24/0087* (2013.01); *A63B 2071/0625* (2013.01)

(58) Field of Classification Search
CPC ..... A63B 71/0622; A63B 24/0075; A63B 24/0087; A63B 2071/0625
See application file for complete search history.

(56) References Cited

U.S. PATENT DOCUMENTS 3,123,646 A 3/1964 Easton
3,579,339 A 5/1971 Chang et al.
4,023,795 A 5/1977 Pauls
4,300,760 A 11/1981 Bobroff
D286,311 S 10/1986 Martinell et al.
4,681,318 A 7/1987 Lay
4,684,126 A 8/1987 Dalebout et al.
4,728,102 A 3/1988 Pauls
4,750,736 A 6/1988 Watterson
4,796,881 A 1/1989 Watterson
4,813,667 A 3/1989 Watterson
4,830,371 A 5/1989 Lay
4,844,451 A 7/1989 Bersonnet et al.
4,850,585 A 7/1989 Dalebout et al.
D304,849 S 11/1989 Watterson
4,880,225 A 11/1989 Lucas et al.
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham et al.
(Continued)

OTHER PUBLICATIONS

U.S. Appl. No. 17/066,485, filed Oct. 9, 2020, Weston et al.
(Continued)

*Primary Examiner* — Sundhara M Ganesan
(74) *Attorney, Agent, or Firm* — Holland & Hart LLP

(57) ABSTRACT

A volume control system may receive and playing a program audio stream at the exercise device, the program audio stream played with a program volume, wherein the program audio stream is part of an exercise program package, the exercise program package including exercise device controls that adjust an operating parameter of the exercise device, the program audio stream synchronized with the exercise device controls. A volume control system may receive and playing a media audio stream at the exercise device, the media audio stream played with a media volume. A volume control system may based on a content of the exercise program package, adjusting a relative volume of the program audio stream to emphasize the program audio stream.

20 Claims, 32 Drawing Sheets

(56) References Cited

U.S. PATENT DOCUMENTS

D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.

(56) References Cited

U.S. PATENT DOCUMENTS 5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson et al.

(56) References Cited

U.S. PATENT DOCUMENTS

D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,636,567 B2 5/2017 Brammer et al.
9,675,839 B2 6/2017 Dalebout et al.
9,682,307 B2 6/2017 Dalebout
9,694,234 B2 7/2017 Dalebout et al.
9,694,242 B2 7/2017 Ashby et al.
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 10/2017 Smith et al.
9,808,672 B2 11/2017 Dalebout
9,849,326 B2 12/2017 Smith
9,878,210 B2 1/2018 Watterson
9,880,805 B1 * 1/2018 Guralnick ..... G06F 3/0482
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
D868,909 S 12/2019 Cutler et al.
10,492,519 B2 12/2019 Capell et al.
10,493,349 B2 12/2019 Watterson
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton et al.
10,561,894 B2 2/2020 Dalebout et al.
10,569,121 B2 2/2020 Watterson
10,569,123 B2 2/2020 Hochstrasser et al.
10,625,114 B2 4/2020 Ercanbrack
10,625,137 B2 4/2020 Dalebout et al.
10,661,114 B2 5/2020 Watterson et al.
10,668,320 B2 6/2020 Watterson
10,671,705 B2 6/2020 Capell et al.
10,688,346 B2 6/2020 Brammer

(56) References Cited

U.S. PATENT DOCUMENTS 10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 9/2020 Olson et al.
10,775,941 B2 * 9/2020 Heath ..... A63B 71/0622
10,786,706 B2 9/2020 Smith
10,864,407 B2 12/2020 Watterson et al.
10,918,905 B2 2/2021 Powell et al.
10,932,517 B2 3/2021 Ashby et al.
10,940,360 B2 3/2021 Dalebout et al.
10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,079,918 B2 * 8/2021 Rotta ..... A63B 22/0664
11,187,285 B2 11/2021 Wrobel
11,273,358 B2 * 3/2022 Tana ..... A63B 24/0075
11,298,577 B2 4/2022 Watterson
11,326,673 B2 5/2022 Buchanan
11,338,169 B2 5/2022 Dalebout et al.
11,338,175 B2 5/2022 Watterson et al.
11,426,633 B2 8/2022 Watterson et al.
11,451,108 B2 9/2022 Tinney
11,452,903 B2 9/2022 Watterson
11,511,152 B2 11/2022 Powell et al.
11,534,651 B2 12/2022 Ercanbrack et al.
11,534,654 B2 12/2022 Silcock et al.
11,534,655 B2 12/2022 Dalebout et al.
11,565,148 B2 1/2023 Dalebout et al.
11,596,830 B2 3/2023 Dalebout et al.
11,642,564 B2 5/2023 Watterson
11,673,036 B2 6/2023 Dalebout et al.
11,680,611 B2 6/2023 Wrobel
11,700,905 B2 7/2023 Ashby et al.
11,708,874 B2 7/2023 Wrobel
11,779,812 B2 10/2023 Watterson
11,794,052 B2 10/2023 Olson et al.
11,794,070 B2 10/2023 Hays et al.
11,794,075 B2 10/2023 Watterson et al.
11,850,497 B2 12/2023 Willardson et al.
11,878,199 B2 1/2024 Smith
11,878,206 B2 1/2024 Dalebout et al.
11,931,621 B2 3/2024 Nascimento
11,951,358 B2 4/2024 Watterson et al.
11,951,377 B2 4/2024 Brammer et al.
2008/0051256 A1 2/2008 Ashby et al.
2015/0251055 A1 9/2015 Ashby
2016/0058335 A1 3/2016 Ashby
2016/0121074 A1 5/2016 Ashby
2016/0346595 A1 12/2016 Dalebout et al.
2017/0124912 A1 5/2017 Ashby et al.
2017/0193578 A1 7/2017 Watterson
2017/0266489 A1 9/2017 Douglass et al.
2017/0270820 A1 9/2017 Ashby et al.
2018/0085630 A1 3/2018 Capell et al.
2018/0099116 A1 4/2018 Ashby
2018/0099180 A1 4/2018 Wilkinson
2018/0111034 A1 4/2018 Watterson
2018/0374383 A1 * 12/2018 Thielen ..... G06T 19/006
2019/0030415 A1 * 1/2019 Volpe, Jr. ..... A63B 22/0076
2019/0223612 A1 7/2019 Watterson et al.
2019/0269971 A1 9/2019 Capell et al.
2020/0009417 A1 1/2020 Dalebout
2021/0001177 A1 1/2021 Smith
2021/0046353 A1 2/2021 Dalebout et al.
2021/0110910 A1 4/2021 Ostler et al.
2021/0146221 A1 5/2021 Dalebout et al.
2021/0205689 A1 * 7/2021 Putnam ..... A63B 24/0075
2021/0299518 A1 9/2021 Brammer et al.
2021/0339079 A1 11/2021 Dalebout et al.
2021/0342952 A1 * 11/2021 Putnam ..... H04N 21/47202
2022/0062685 A1 3/2022 Ashby et al.
2022/0104992 A1 4/2022 Ashby
2022/0212052 A1 7/2022 Ercanbrack et al.
2022/0241649 A1 8/2022 Ashby
2022/0241665 A1 8/2022 Dalebout et al.
2022/0241668 A1 8/2022 Willardson et al.
2022/0249912 A1 8/2022 Watterson et al.
2022/0258007 A1 8/2022 Watterson et al.
2022/0258008 A1 8/2022 Watterson et al.
2022/0276826 A1 * 9/2022 Hankins ..... H04B 1/0343
2022/0280857 A1 9/2022 Watterson
2022/0309042 A1 9/2022 Archer
2022/0314078 A1 10/2022 Watterson et al.
2022/0339493 A1 10/2022 Larsen
2022/0339520 A1 10/2022 Toth
2022/0342969 A1 10/2022 Watterson et al.
2022/0347516 A1 11/2022 Taylor
2022/0347524 A1 * 11/2022 Kim ..... A63B 21/0056
2022/0347548 A1 11/2022 Watterson
2022/0362613 A1 11/2022 Watterson et al.
2022/0362624 A1 11/2022 Dalebout
2022/0395729 A1 12/2022 Toth
2023/0039903 A1 2/2023 Brammer et al.
2023/0054845 A1 2/2023 Smith
2023/0122235 A1 4/2023 Ashby et al.
2023/0128721 A1 4/2023 Plummer
2023/0158358 A1 5/2023 Ercanbrack et al.
2023/0181993 A1 6/2023 Taylor et al.
2023/0191189 A1 6/2023 Taylor et al.
2023/0191197 A1 6/2023 Ashby
2023/0218975 A1 7/2023 Toles et al.
2023/0226401 A1 7/2023 Watterson
2023/0271056 A1 8/2023 Cutler et al.
2023/0277892 A1 9/2023 Smith et al.
2023/0285799 A1 9/2023 Dalebout et al.
2023/0304548 A1 9/2023 Wrobel
2023/0321482 A1 10/2023 Vasquez et al.
2023/0330476 A1 10/2023 Ashby et al.
2023/0360248 A1 11/2023 Ashby et al.
2023/0398402 A1 12/2023 Chuang
2023/0405439 A1 12/2023 Brammer et al.
2024/0024734 A1 1/2024 Nielsen et al.
2024/0108938 A1 4/2024 Smith
2024/0108965 A1 4/2024 Willardson et al.

OTHER PUBLICATIONS

U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/123,026, filed Mar. 17, 2023, Silcock et al.
U.S. Appl. No. 18/210,505, filed Jun. 15, 2023, Nielsen et al.
U.S. Appl. No. 18/622,665, filed Mar. 29, 2024, Watterson et al.
U.S. Appl. No. 18/660,217, filed May 9, 2024, Capell.
U.S. Appl. No. 18/678,779, filed May 30, 2024, Powell et al.
U.S. Appl. No. 29/702,127, filed Sep. 16, 2019, Cutler et al.
U.S. Appl. No. 29/932,908, filed Mar. 15, 2024, Hoggarth et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.

(56) References Cited

OTHER PUBLICATIONS

U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.
U.S. Appl. No. 63/620,620, filed Jan. 12, 2024, Brammer.
U.S. Appl. No. 63/620,614, filed Jan. 12, 2024, Brammer et al.
U.S. Appl. No. 63/621,529, filed Jan. 16, 2024, Brammer.
U.S. Appl. No. 63/622,504, filed Jan. 18, 2024, Brammer.
U.S. Appl. No. 63/550,323, filed Feb. 6, 2024, Brammer.
U.S. Appl. No. 63/555,768, filed Feb. 20, 2024, Nielsen.
U.S. Appl. No. 63/566,053, filed Mar. 15, 2024, Hoggarth et al.
U.S. Appl. No. 63/566,041, filed Mar. 15, 2024, Nascimento et al.
U.S. Appl. No. 63/568,912, filed Mar. 22, 2024, Hoggarth et al.
U.S. Appl. No. 63/631,279, filed Apr. 8, 2024, Brammer et al.
U.S. Appl. No. 63/654,638, filed May 31, 2024, Nascimento.

* cited by examiner

DEVICES, SYSTEMS, AND METHODS FOR EXERCISE DEVICE CONTROL

BACKGROUND

Health is a critical part of a person's well-being. People cultivate their health through health actions, including exercise, diet, lifestyle, and so forth. People may use exercise systems to facilitate their health journey. Indoor exercise has increased in popularity and accessibility. Many people exercise indoors with the aid of an exercise device. Exercise devices may be designed to simulate outdoor exercise activities, such as a treadmill to simulate running, a stationary bicycle to simulate cycling, or a rower to simulate rowing. Additionally, or alternatively, exercise devices may be designed to exercise a certain muscle or muscle group, reduce the impact or force applied to the user, aid in certain types of indoor exercises, perform any other function, and combinations thereof.

BRIEF SUMMARY

In some aspects, the techniques described herein relate to a method implemented on an exercise device. A volume control system receives and plays a program audio stream at the exercise device. The program audio stream is played with a program volume. The program audio stream is part of an exercise program package. The exercise program package includes exercise device controls that adjust an operating parameter of the exercise device. The program audio stream is synchronized with the exercise device controls. The volume control system receives and plays a media audio stream at the exercise device. The media audio stream is played with a media volume. Based on a content of the exercise program package, the volume control system adjusts a relative volume of the program audio stream to emphasize the program audio stream.

In some aspects, the techniques described herein relate to a method implemented on an exercise device. The exercise device implements an exercise program package. The exercise program package includes exercise device controls that adjust an operating parameter of the exercise device. The exercise program package further includes a program video stream and a program audio stream. The program video stream and the program audio stream are synchronized with the exercise device controls. The program audio stream is played through speakers on the exercise device. The exercise device presents third-party media on the exercise device. The exercise device displays, on a display of the exercise device, a media video stream of the third-party media and a media audio stream through the speakers. When the exercise program package reaches a priority content, the volume control system alters a relative volume of the media audio stream.

In some aspects, the techniques described herein relate to a method for operating an exercise device. The exercise device implements an exercise program package on the exercise device. The exercise program package includes a video portion and a program media stream. The video portion is displayed on a display of the exercise device and the program media stream is played on a speaker of the exercise device. While displaying the video portion on the display and playing the program media stream on the speaker of the exercise device, the exercise device receives a selection of a selectable icon overlaid over the video portion on the display. Based on the selection, and while implementing the exercise program package, the exercise device replaces the video portion on the display with a media video portion of a third party media and playing a media video stream simultaneously with the program media stream.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which.

DETAILED DESCRIPTION

This disclosure generally relates to devices, systems, and methods for controlling an exercise device. A graphical user interface for an exercise device includes one or more selectable icons presented on a video display overlaid over a video (such as third-party media and/or an exercise program). Selection of the selectable icons may facilitate changing of one or more settings of the exercise device. In accordance with at least one embodiment of the present disclosure, selection of the selectable icons may change a setting of the exercise device without interrupting playing of the media on the display. In some embodiments, selection of the selectable icons may display third-party media on the display without interrupting the implementation of the exercise program. This may allow the user to seamlessly select and implement the exercise program and third-party media based on his or her desires and interests.

In accordance with at least one embodiment of the present disclosure, the user may adjust the relative volume of the audio streams of the exercise program and the third-party media. For example, while the user is performing a workout based on the exercise program that the exercise device implements, the user may increase the relative volume of the third-party media and decrease the relative volume of the exercise program. In some embodiments, the exercise device may, based on content of the exercise program, adjust the relative volume of the exercise program to emphasize or highlight the audio stream of the exercise program. This may facilitate the user hearing critical instructions, raising the user's awareness of changes to the operating parameters of the exercise device, and highlighting other portions of the exercise program. In this manner, the safety of the implementation of the exercise device may be increased.

Figure 1:
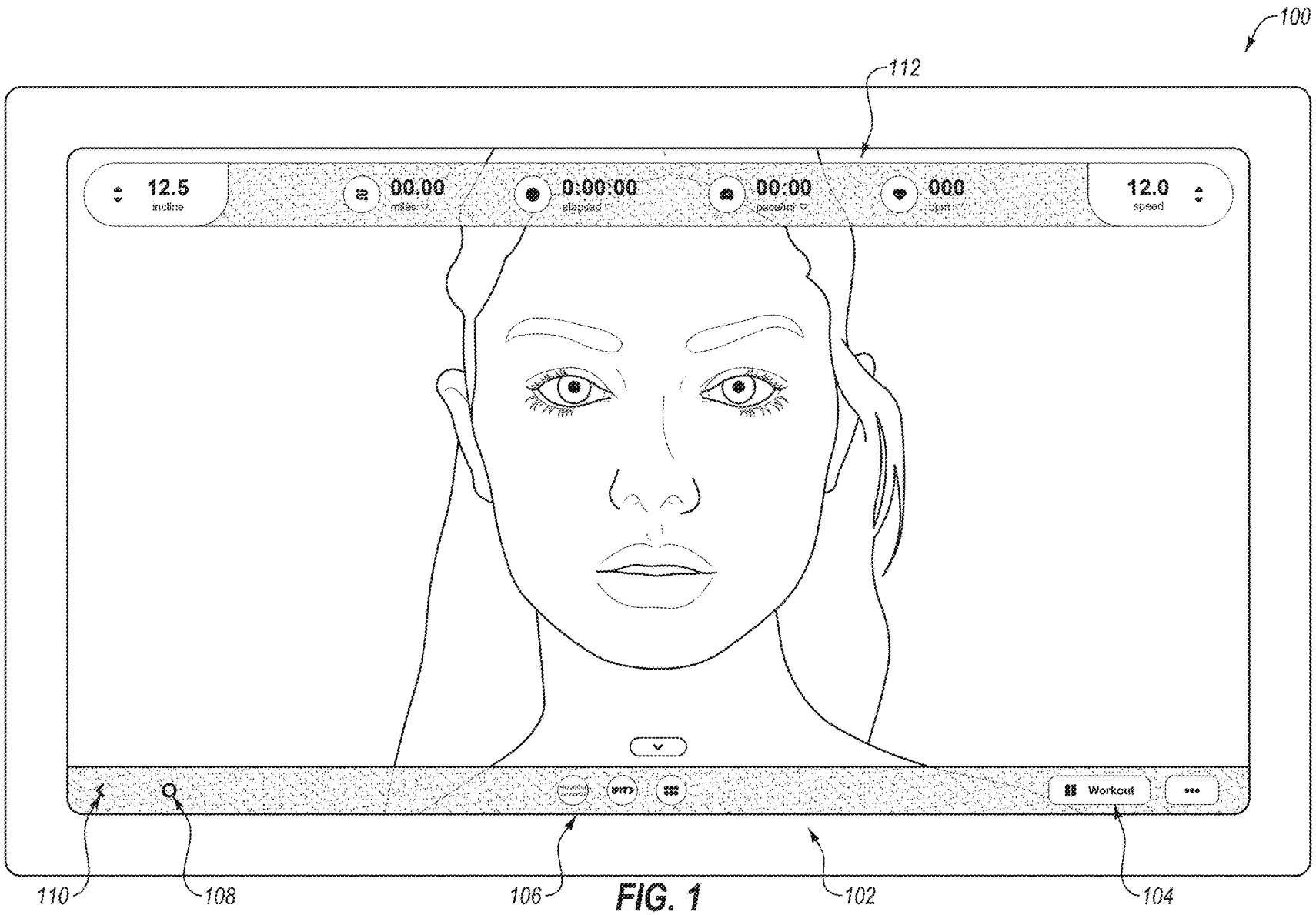
FIG. 1 is a representation of a graphical user interface (GUI) that may be presented on a display of an exercise device, according to at least one embodiment of the present disclosure.

FIG. 1 is a representation of a graphical user interface (GUI) 100 that may be presented on a display of an exercise device, according to at least one embodiment of the present disclosure. The GUI 100 may include a background image or video display. The background image or video display may be an image or video from any source, such as an image or video from an exercise program or an image or video from third-party media. The third-party media may be any third-party media, including streaming videos streamed via a streaming service, television shows, movies, user original content, home videos, any third-party media, and combinations thereof.

The GUI illustrated includes one or more menus. A lower menu 102 or banner located along a lower surface of the GUI 100 includes buttons or selectable icons that may be selected to perform functions. For example, the lower menu may include workout controls 104, media controls 106, a home button 108, a back button 110, and so forth.

While implementing an exercise program, the user may select one of the selectable icons. Without interrupting the media displayed in the background of the GUI 100 and/or without interrupting the exercise program, the selection of the selectable icon may open a menu and/or change screens to allow the user to perform further actions. For example, when the user presses the workout controls 104 selectable icon, the exercise device may adjust the exercise program, such as by pausing the exercise program or adjusting one or more of the exercise device parameters. In some embodiments, when the user presses the media controls 106, a new media application may open, allowing the user to select additional media without interrupting the exercise program. When the user presses the home button 108, the user may be taken to a screen allowing him or her to select additional media, adjust setting, adjust the exercise program, and so forth. The back button 110 may take the user to a previously viewed screen.

The GUI 100 may further include a top banner 112. The top banner 112 may overlay the background image. The top banner 112 may include information regarding the exercise activity, such as distance, time elapsed, pace, heartrate, incline, speed, and so forth. One or more of the elements of the top banner 112 may be a selectable icon. This may pull up additional menus or elements that may provide additional information about the exercise program and/or allow the operator to adjust the operating parameters of the exercise program.

Figure 2:
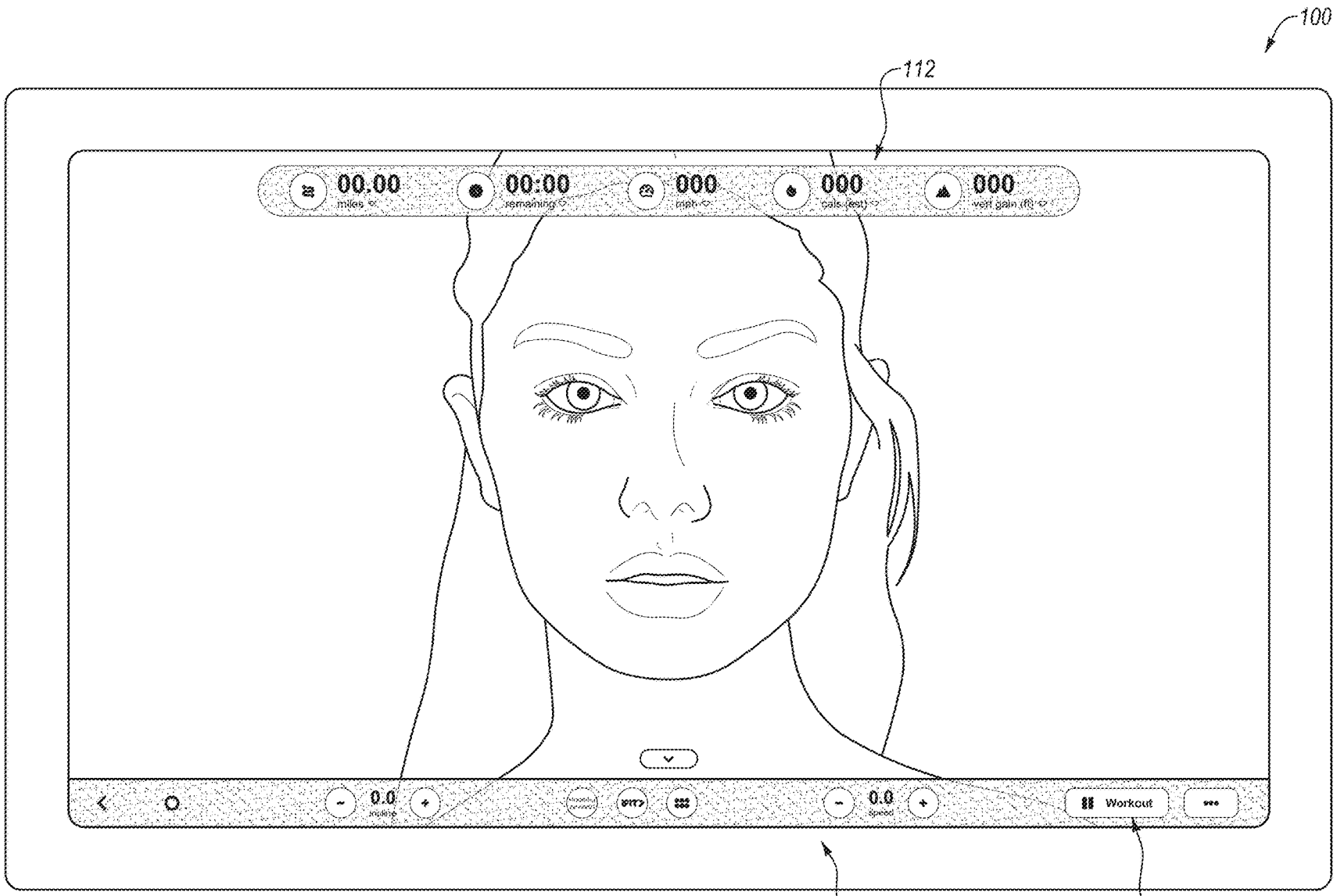
FIG. 2 is a representation of a GUI that may be presented on a display of an exercise device, according to at least one embodiment of the present disclosure.

FIG. 2 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, the lower menu 102 includes additional workout controls 104, such as speed and incline controls. The workout controls 104 may be selectable icons. When the user selects the selectable icons, the exercise device may change the operating parameters of the exercise device without stopping playing of the third-party media in the background of the GUI 100.

Figure 3:
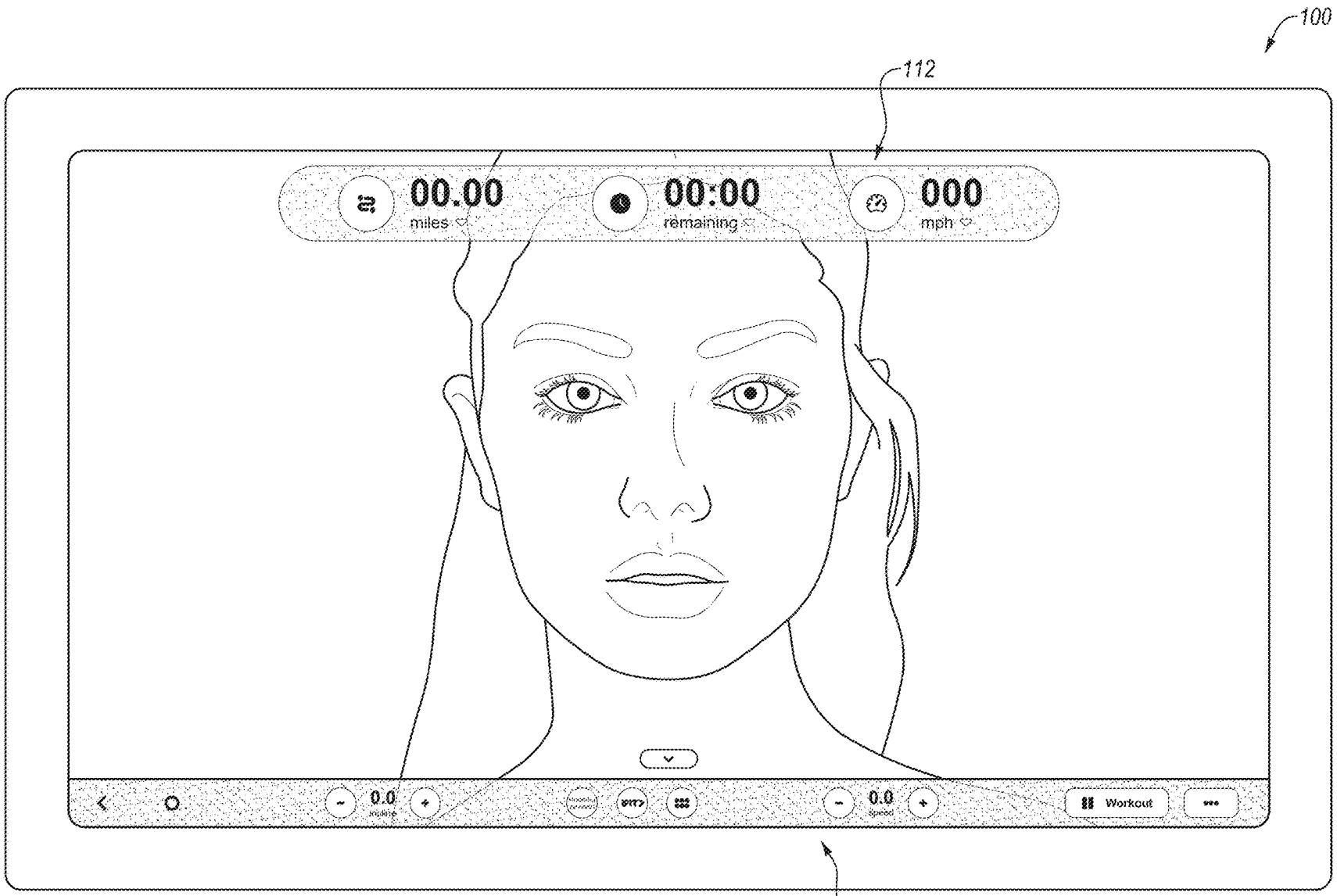
FIG. 3 is a representation of a GUI that may be presented on a display of an exercise device, according to at least one embodiment of the present disclosure.

FIG. 3 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, the top banner 112 includes three icons representing exercise information, including distance traveled, time remaining, and speed. While seven icons are illustrated in FIG. 1 and FIG. 2, and three icons are illustrated in FIG. 3, it should be understood that any number of icons may be illustrated in the top banner 112.

Figure 4:
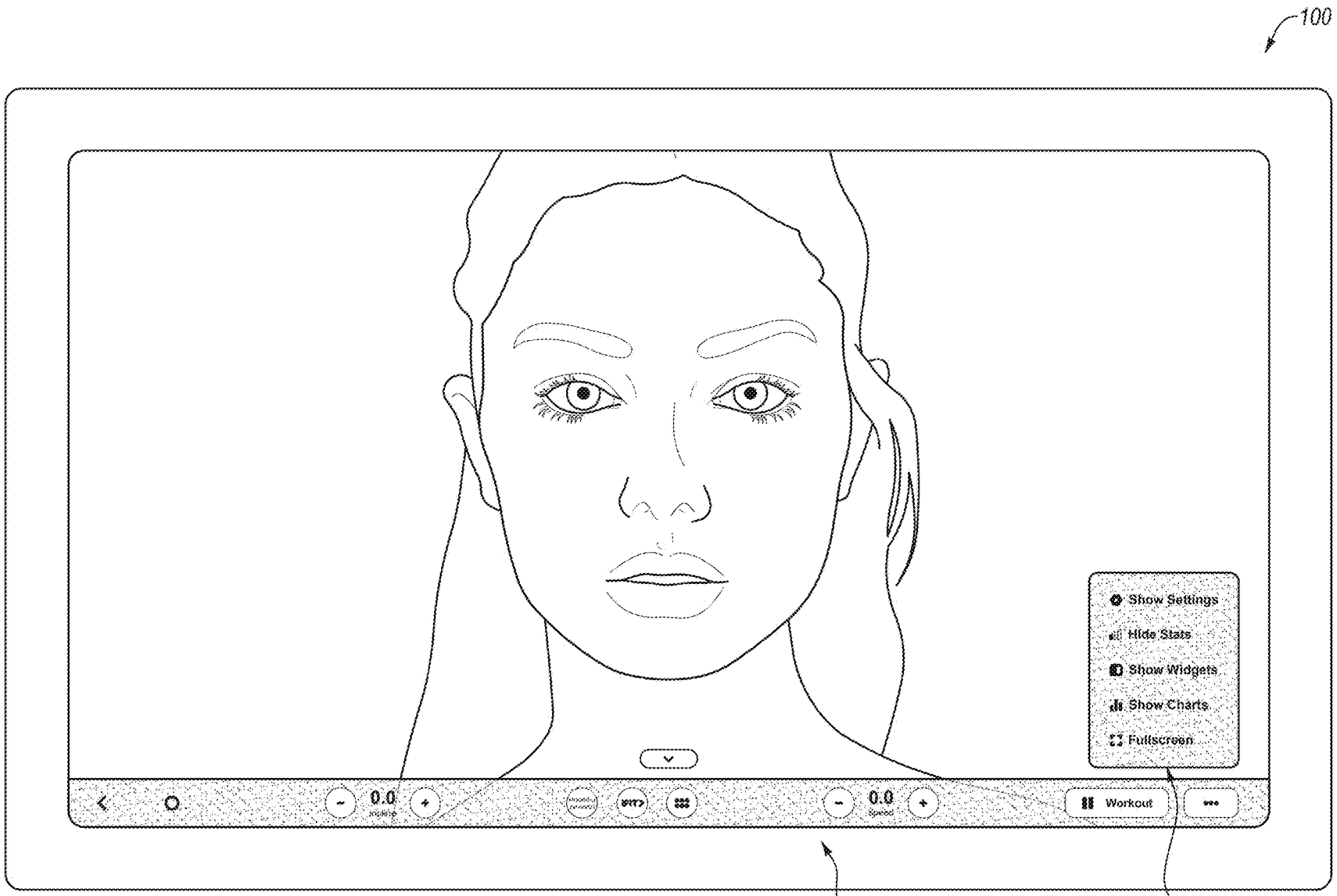
FIG. 4 is a representation of a GUI that may be presented on a display of an exercise device, according to at least one embodiment of the present disclosure.

FIG. 4 is a representation of a GUI 100 that may be presented on a display of an exercise device, according to at least one embodiment of the present disclosure. The GUI 100 may include a background image or video display, with a lower menu 102 overlaid over the video display. In the embodiment shown, a settings menu 114 may be overlaid over the video display. The settings menu 114 may be invoked or presented based on the selection of a selectable icon. The settings menu 114 may allow the user to change one or more settings of the GUI 100, such as the presentation of one or more of settings, statistics, widgets, charts, and fullscreen mode. Selection of the selectable icons in the settings menu 114 may cause the exercise device to overlay the associated menu, banner, widget, or chart over the background image. As discussed herein, selection of the selectable icons may cause the exercise device to overlay the associated element while playing the media and/or exercise program on the display (e.g., without interrupting the media and/or the exercise program).

Figure 5:
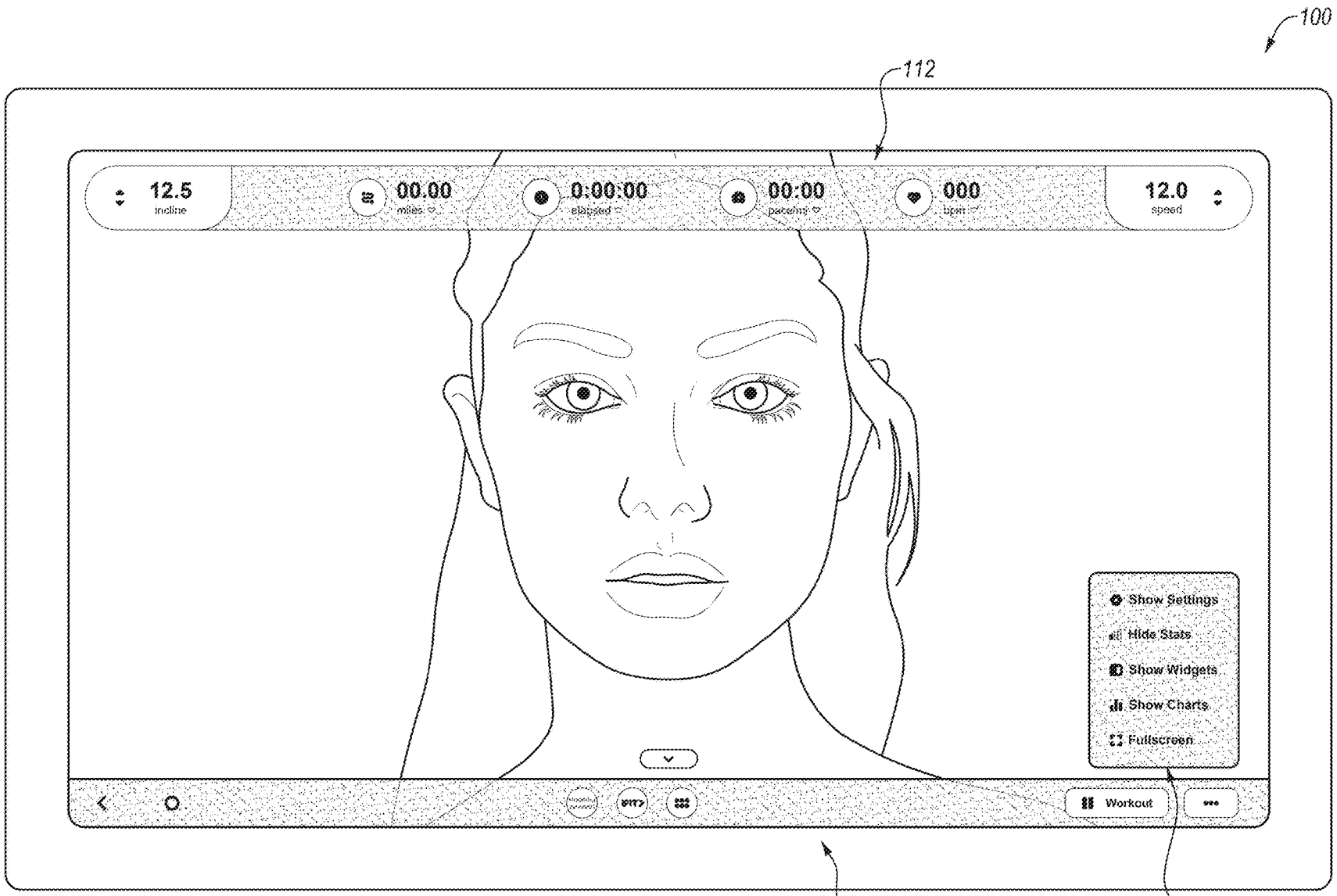
FIG. 5 is a representation of a GUI that may be presented on a display of an exercise device, according to at least one embodiment of the present disclosure.

FIG. 5 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a settings menu 114 may be overlaid over the video display. The settings menu 114 may be invoked or presented based on the selection of a selectable icon. The settings menu 114 may allow the user to change one or more settings of the GUI 100, such as the presentation of one or more of settings, statistics, widgets, charts, and fullscreen mode. Selection of the selectable icons in the settings menu 114 may cause the exercise device to overlay the associated menu, banner, widget, or chart over the background image. As discussed herein, selection of the selectable icons may cause the exercise device to overlay the associated element while playing the media and/or exercise program on the display (e.g., without interrupting the media and/or the exercise program).

Figure 6:
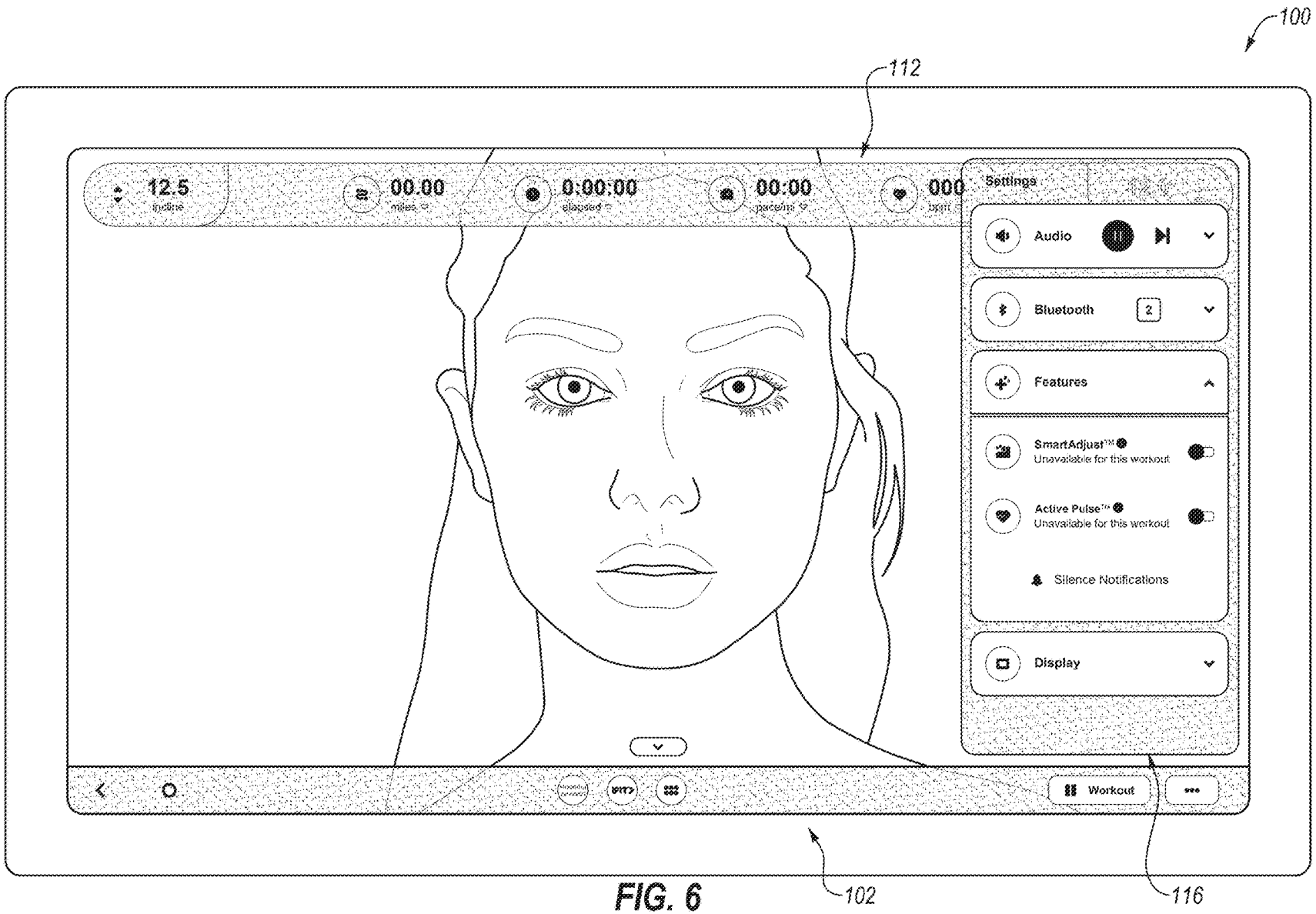
FIG. 6 is a representation of a GUI that may be presented on a display of an exercise device, according to at least one embodiment of the present disclosure.

FIG. 6 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a media settings menu 116 may be overlaid over the video display and the top banner 112. The media settings menu 116 may be invoked or presented based on the selection of a selectable icon. The media settings menu 116 may allow the user to change one or more settings of the GUI 100, such as the presentation of one or more of audio controls, Bluetooth connection (or other wireless connection), exercise program features, display settings. Selection of the selectable icons in the media settings menu 116 may cause the exercise device to adjust the associated setting. As discussed herein, adjusting the settings in the media settings menu 116 may occur while playing the media and/or exercise program on the display (e.g., without interrupting the media and/or the exercise program).

Figure 7:
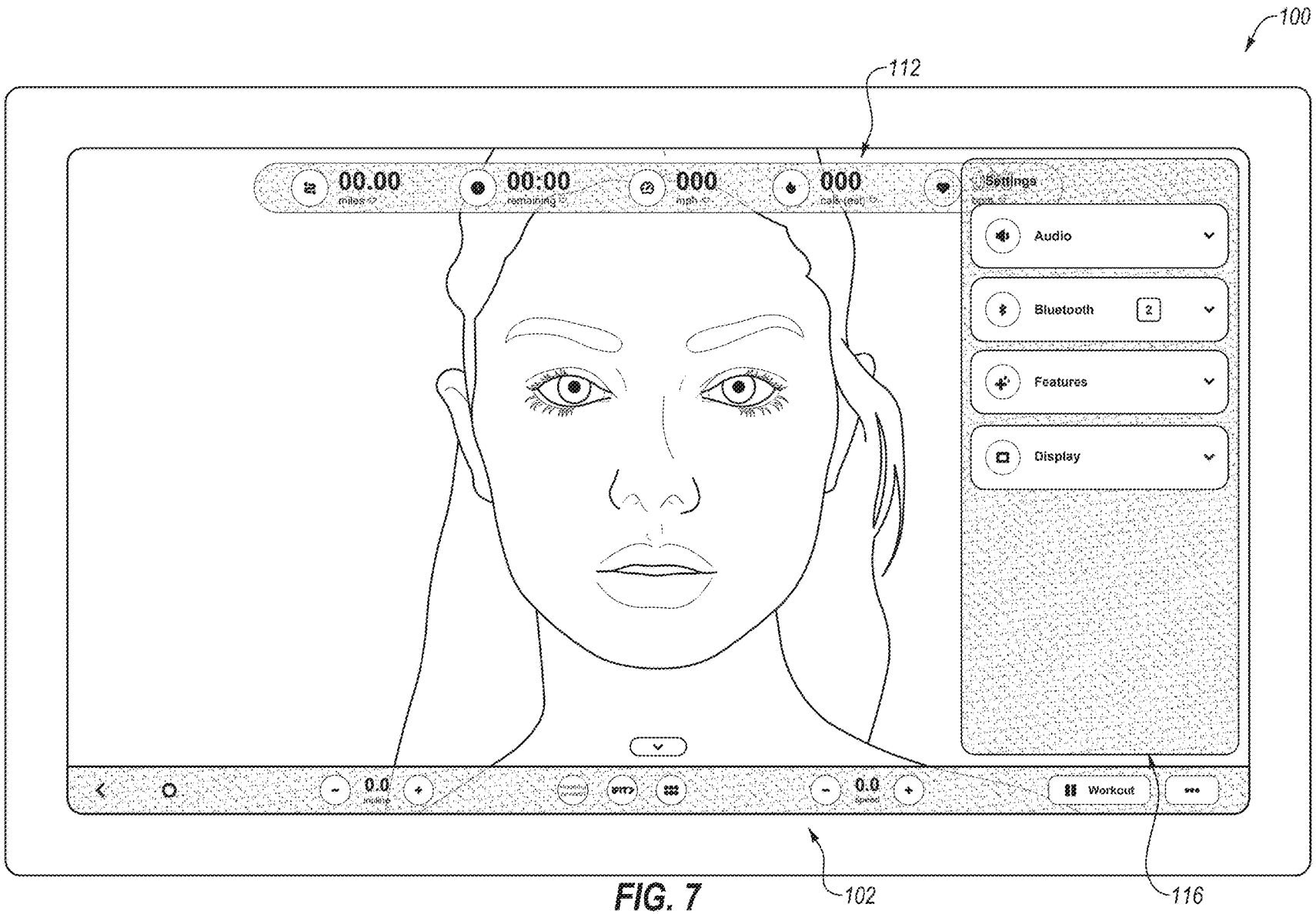
FIG. 7 is a representation of a GUI that may be presented on a display of an exercise device, according to at least one embodiment of the present disclosure.

FIG. 7 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a media settings menu 116 may be overlaid over the video display and the top banner 112. The media settings menu 116 may be invoked or presented based on the selection of a selectable icon. The media settings menu 116 may allow the user to change one or more settings of the GUI 100, such as the presentation of one or more of audio controls, Bluetooth connection (or other wireless connection), exercise program features, display settings. Selection of the selectable icons in the media settings menu 116 may cause the exercise device to adjust the associated setting. As discussed herein, adjusting the settings in the media settings menu 116 may occur while playing the media and/or exercise program on the display (e.g., without interrupting the media and/or the exercise program).

Figure 8:
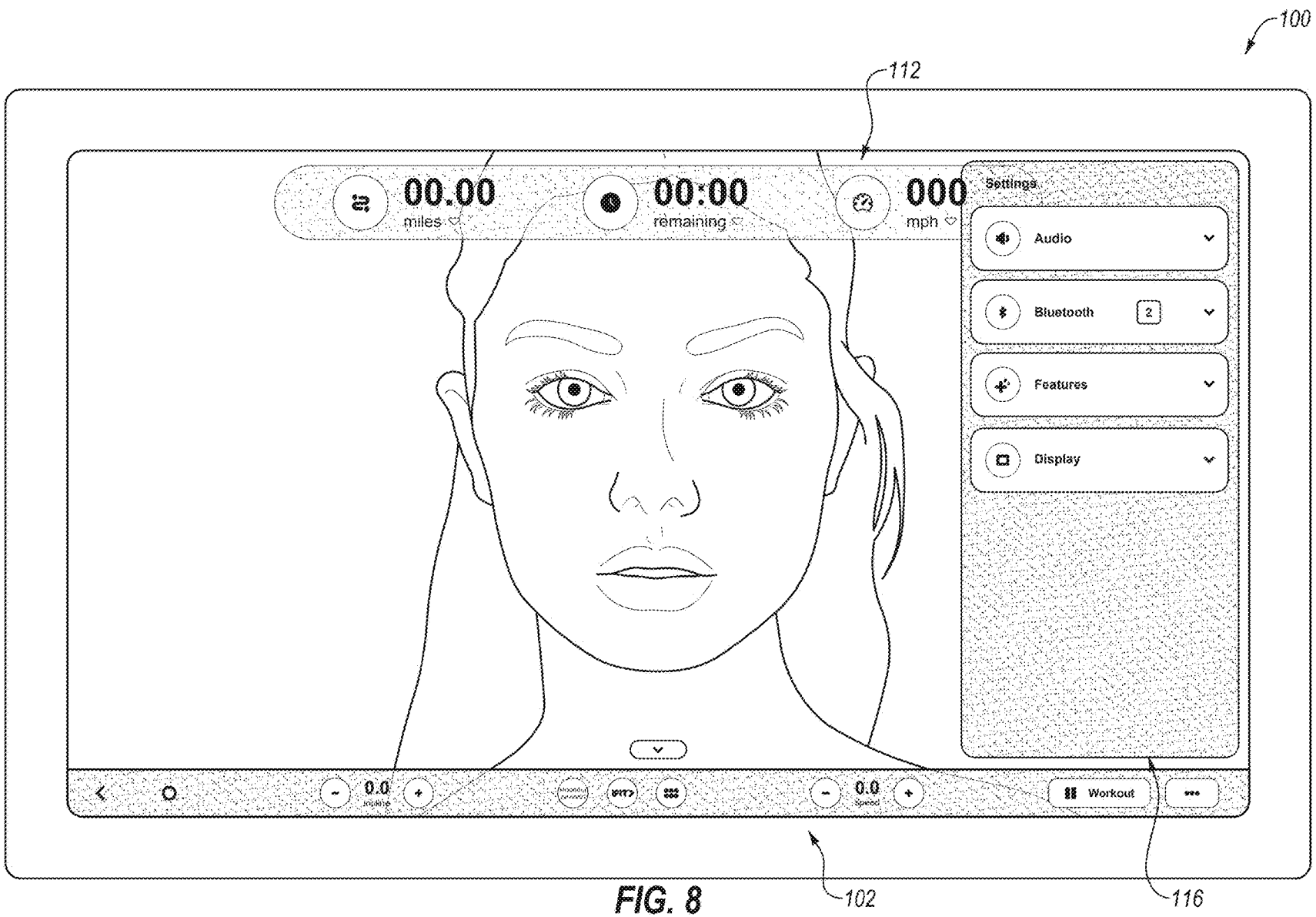
FIG. 8 is a representation of a GUI that may be presented on a display of an exercise device, according to at least one embodiment of the present disclosure.

FIG. 8 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a media settings menu 116 may be overlaid over the video display and the top banner 112. The media settings menu 116 may be invoked or presented based on the selection of a selectable icon. The media settings menu 116 may allow the user to change one or more settings of the GUI 100, such as the presentation of one or more of audio controls, Bluetooth connection (or other wireless connection), exercise program features, display settings. Selection of the selectable icons in the media settings menu 116 may cause the exercise device to adjust the associated setting. As discussed herein, adjusting the settings in the media settings menu 116 may occur while playing the media and/or exercise program on the display (e.g., without interrupting the media and/or the exercise program).

Figure 9:
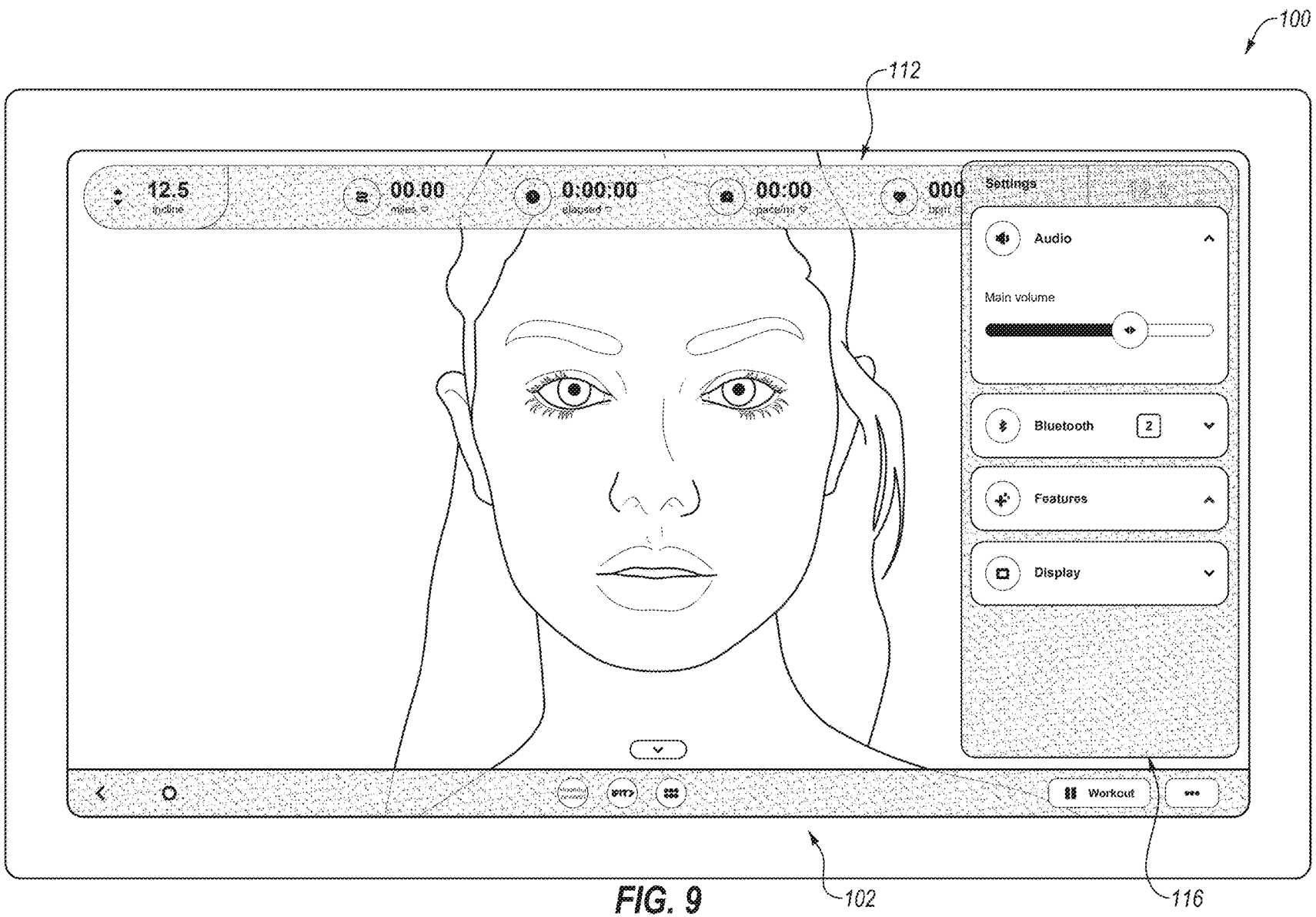
FIG. 9 is a representation of a GUI that may be presented on a display of an exercise device, according to at least one embodiment of the present disclosure.

FIG. 9 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a media settings menu 116 may be overlaid over the video display and the top banner 112. The media settings menu 116 may be invoked or presented based on the selection of a selectable icon. The media settings menu 116 may allow the user to change one or more settings of the GUI 100, such as the presentation of one or more of audio controls, Bluetooth connection (or other wireless connection), exercise program features, display settings. Selection of the selectable icons in the media settings menu 116 may cause the exercise device to adjust the associated setting. The user may adjust settings in any manner, such as via a slider or two-position button. As discussed herein, adjusting the settings in the media settings menu 116 may occur while playing the media and/or exercise program on the display (e.g., without interrupting the media and/or the exercise program).

Figure 10:
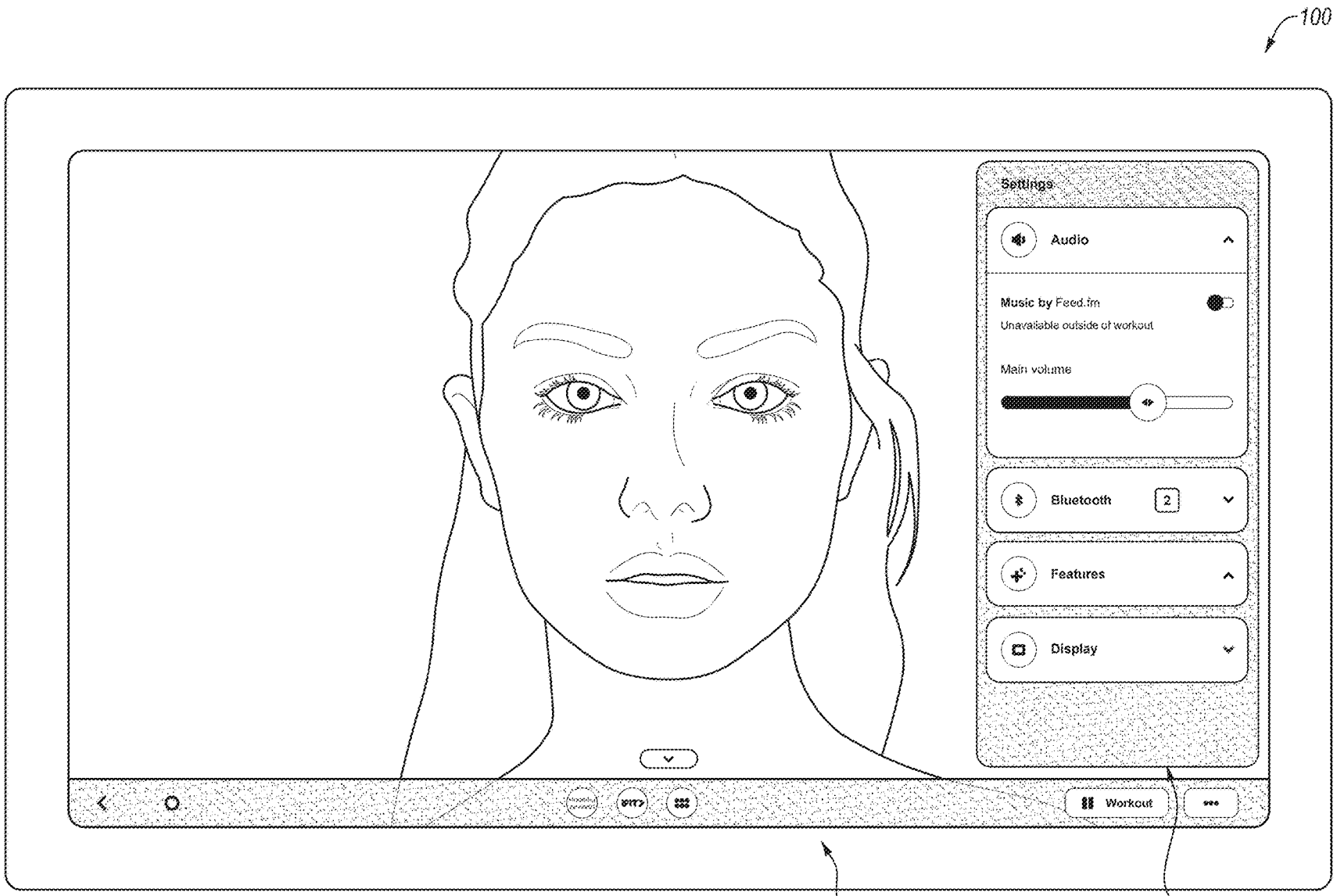
FIG. 10 is a representation of a GUI that may be presented on a display of an exercise device, according to at least one embodiment of the present disclosure.

FIG. 10 is a representation of a GUI 100 that may be presented on a display of an exercise device, according to at least one embodiment of the present disclosure. The GUI 100 may include a background image or video display, with a lower menu 102 overlaid over the video display. In the embodiment shown, a media settings menu 116 may be overlaid over the video display. The media settings menu 116 may be invoked or presented based on the selection of a selectable icon. The media settings menu 116 may allow the user to change one or more settings of the GUI 100, such as the presentation of one or more of audio controls, Bluetooth connection (or other wireless connection), exercise program features, display settings. Selection of the selectable icons in the media settings menu 116 may cause the exercise device to adjust the associated setting. The user may adjust settings in any manner, such as via a slider or two-position button. As discussed herein, adjusting the settings in the media settings menu 116 may occur while playing the media and/or exercise program on the display (e.g., without interrupting the media and/or the exercise program).

Figure 11:
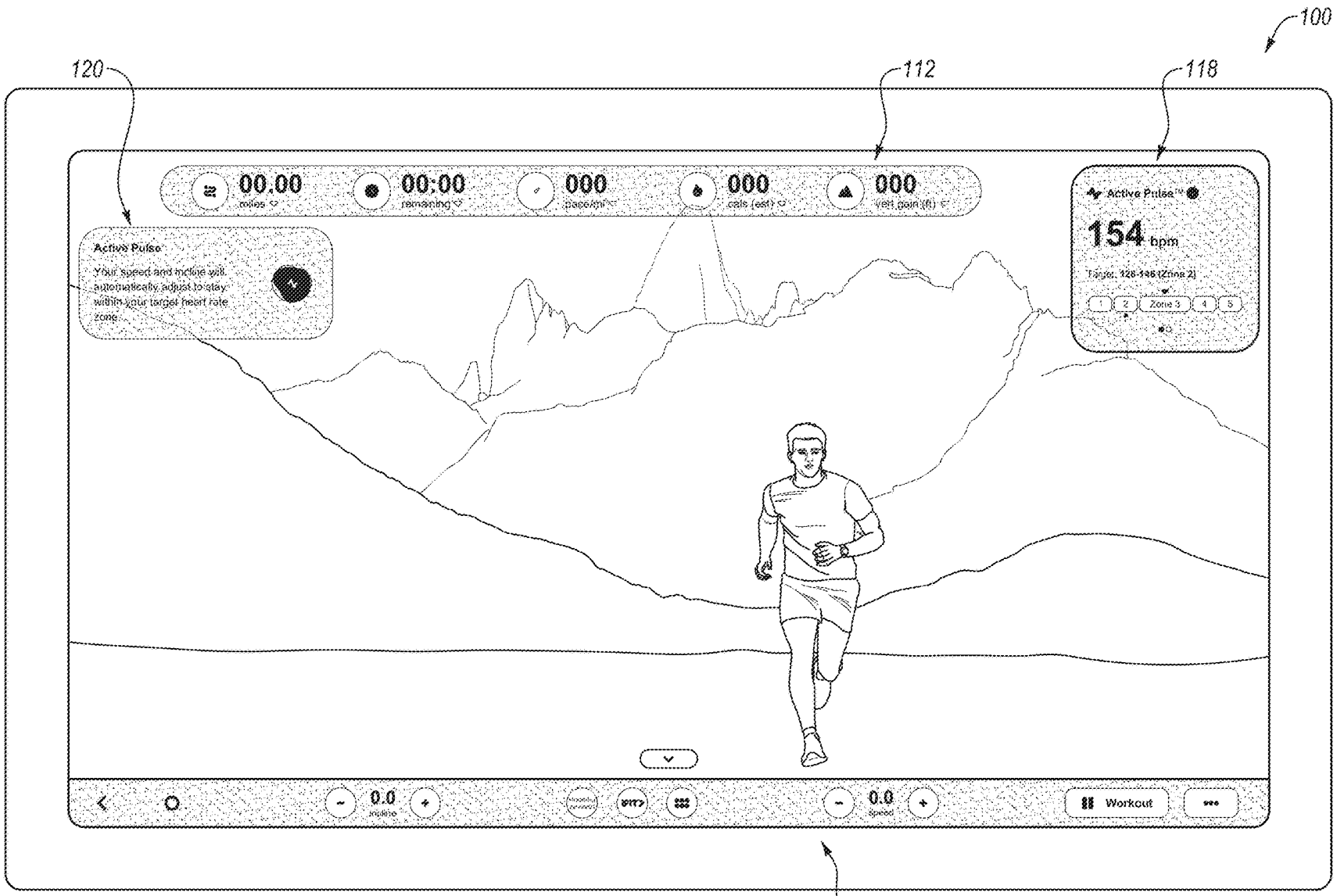
FIG. 11 is a representation of a GUI that may be presented on a display of an exercise device, according to at least one embodiment of the present disclosure.

FIG. 11 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a widget 118 is overlaid over the background display. Presentation of the widget 118 has pushed the top banner 112 to the left to allow both the widget 118 and all of the elements or icons of the top banner 112 to be shown. The widget 118 may include any type of information, including heartrate and/or heartrate zone information. The GUI 100 further includes a notification 120. The notification 120 may provide the user with information. The information may be any type of information, such as training information, heartrate information, health information, any other information, and combinations thereof.

Figure 12:
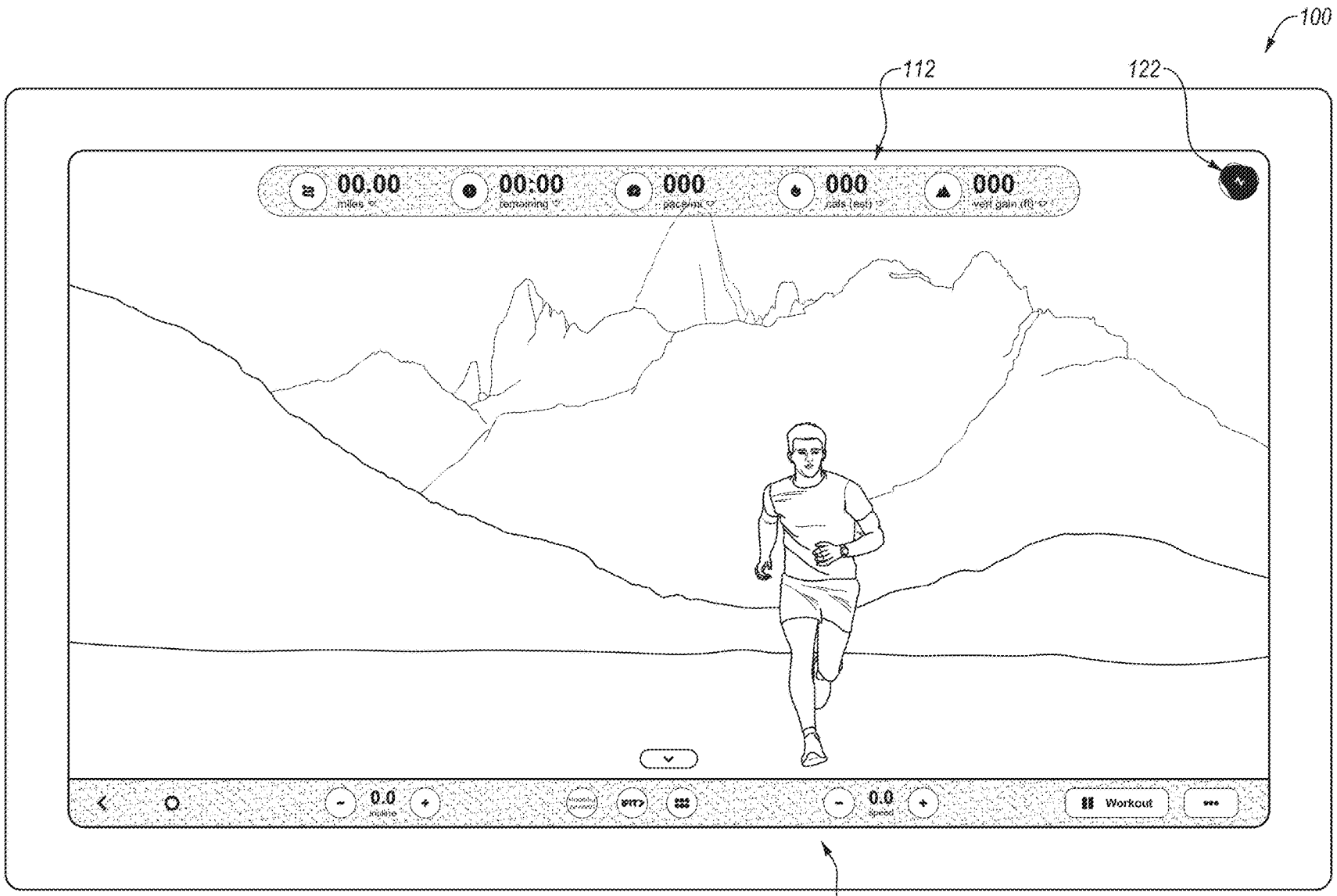
FIG. 12 is a representation of a GUI that may be presented on a display of an exercise device, according to at least one embodiment of the present disclosure.

FIG. 12 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a training button 122 is overlaid over the background display. Selection of the training button 122 may facilitate the presentation of the widget 118 and/or the notification 120 illustrated in FIG. 11.

Figure 13:
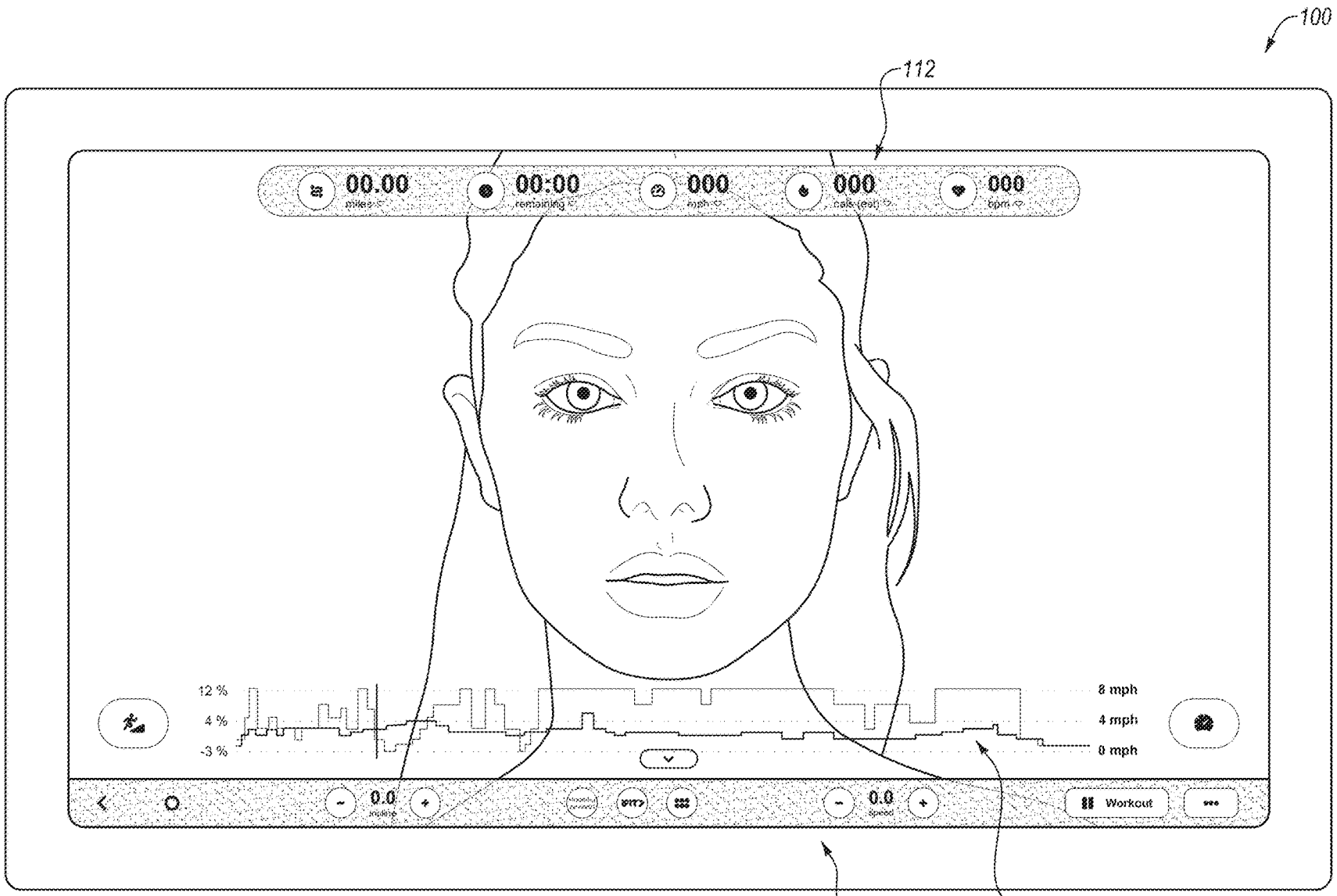
FIG. 13 is a representation of a GUI that may be presented on a display of an exercise device, according to at least one embodiment of the present disclosure.

FIG. 13 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a chart 124 is overlaid over the background display above the lower menu 102. The chart 124 may include information associated with the exercise program, such as incline and/or speed. Multiple parameters may be illustrated on the chart 124.

Figure 14:
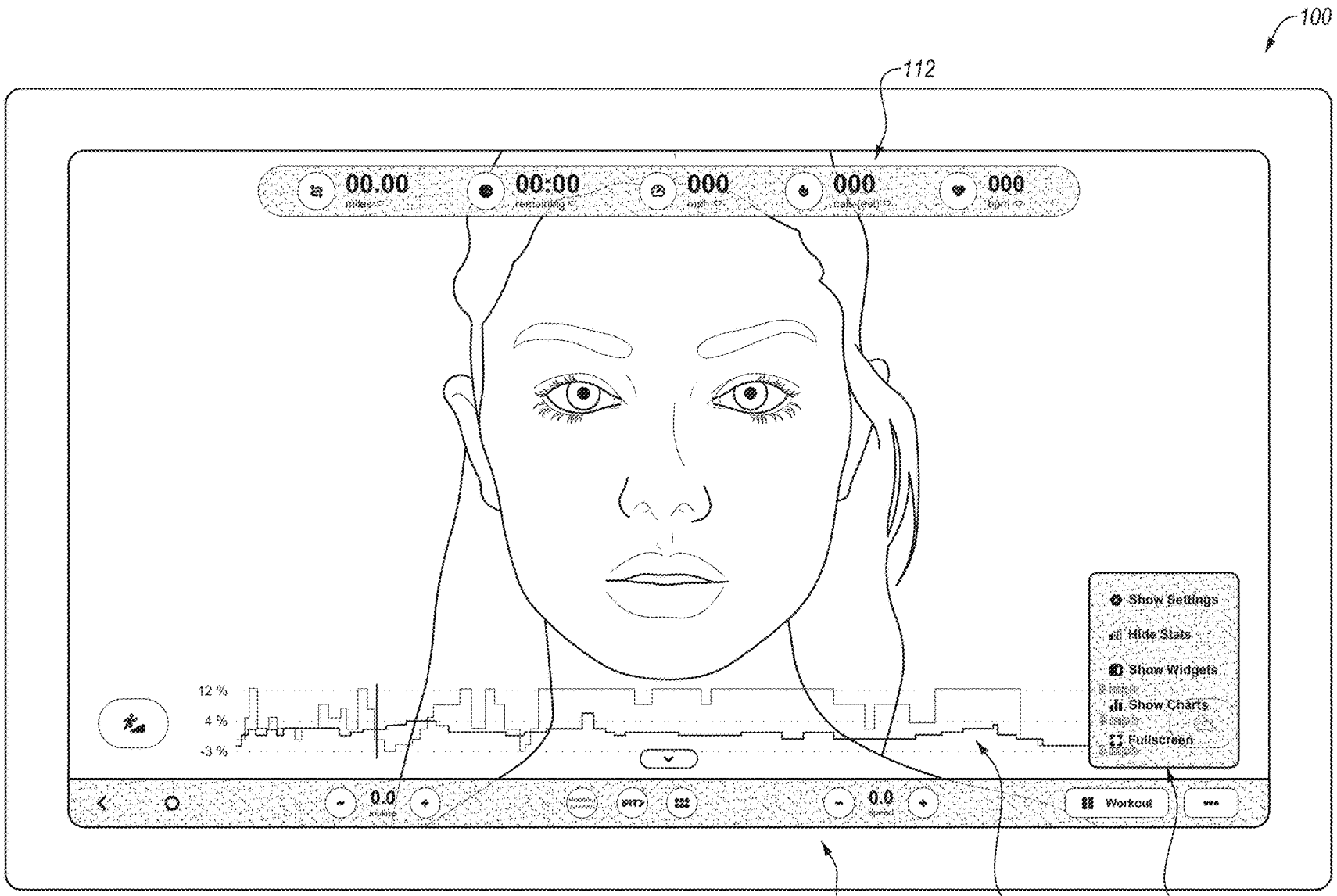
FIG. 14 is a representation of a GUI that may be presented on a display of an exercise device, according to at least one embodiment of the present disclosure.

FIG. 14 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a chart 124 is overlaid over the background display above the lower menu 102. The chart 124 may include information associated with the exercise program, such as incline and/or speed. Multiple parameters may be illustrated on the chart 124. In the embodiment shown, a settings menu 114 may be overlaid over the video display, including the chart 124. The settings menu 114 may be invoked or presented based on the selection of a selectable icon. The settings menu 114 may allow the user to change one or more settings of the GUI 100, such as the presentation of one or more of settings, statistics, widgets, charts, and fullscreen mode.

Figure 15:
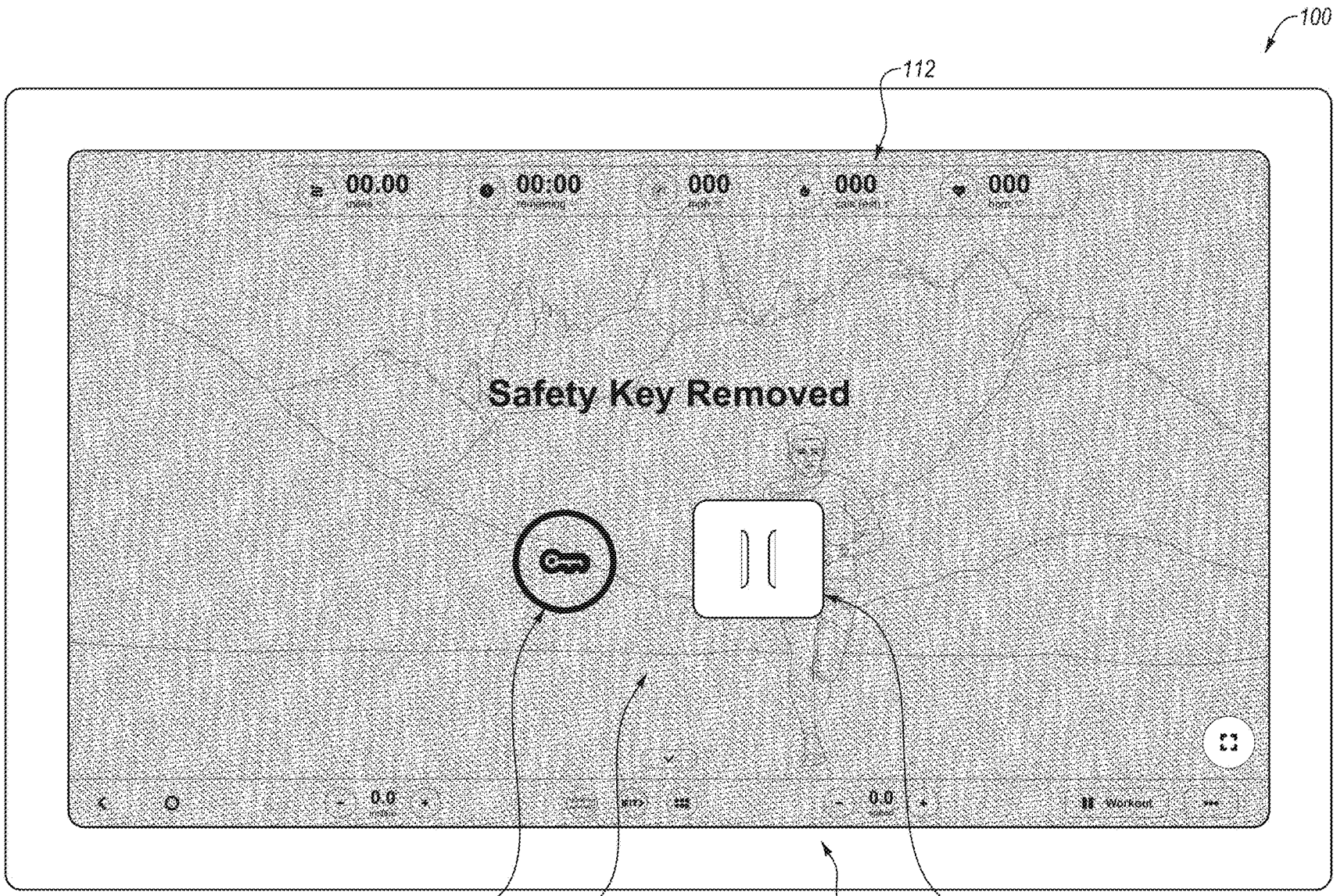
FIG. 15 is a representation of a GUI that may be presented on a display of an exercise device, according to at least one embodiment of the present disclosure.

FIG. 15 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a warning 126 is overlaid over an entirety of the display, including overlaid over the top banner 112 and the lower menu 102. The warning 126 includes icons describing the warning, including a pause icon 128 and a key icon 130. In the embodiment shown, the warning 126 indicates that the safety key is removed from the exercise device. During presentation of the warning, the exercise program and/or the third-party media may be stopped.

Figure 16:
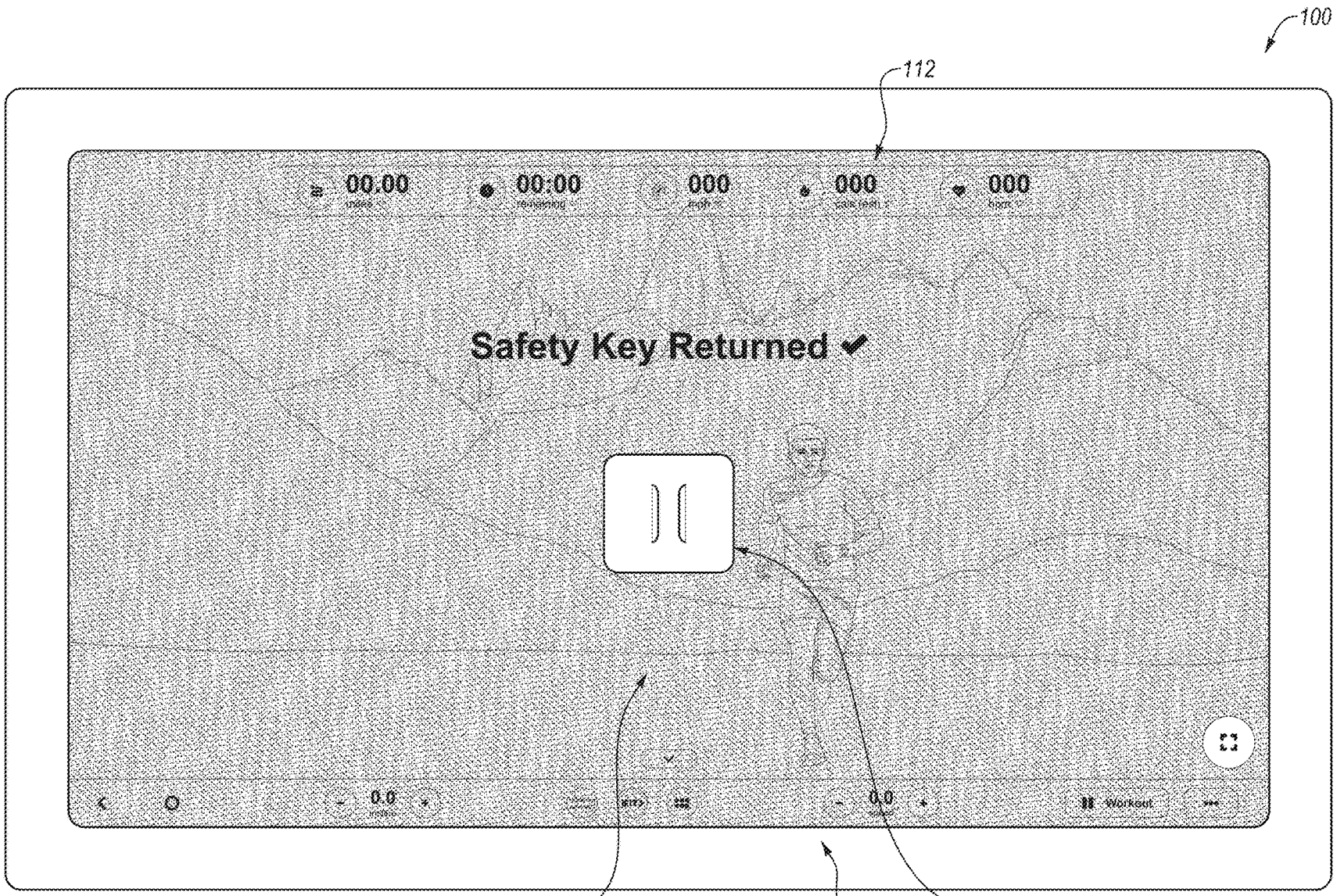
FIG. 16 is a representation of a GUI that may be presented on a display of an exercise device, according to at least one embodiment of the present disclosure.

FIG. 16 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a warning 126 is overlaid over an entirety of the display, including overlaid over the top banner 112 and the lower menu 102. The warning 126 includes icons describing the warning, including a pause icon 128. In the embodiment shown, the safety key has been returned, and the user may resume the exercise program by pressing the pause icon 128.

Figure 17:
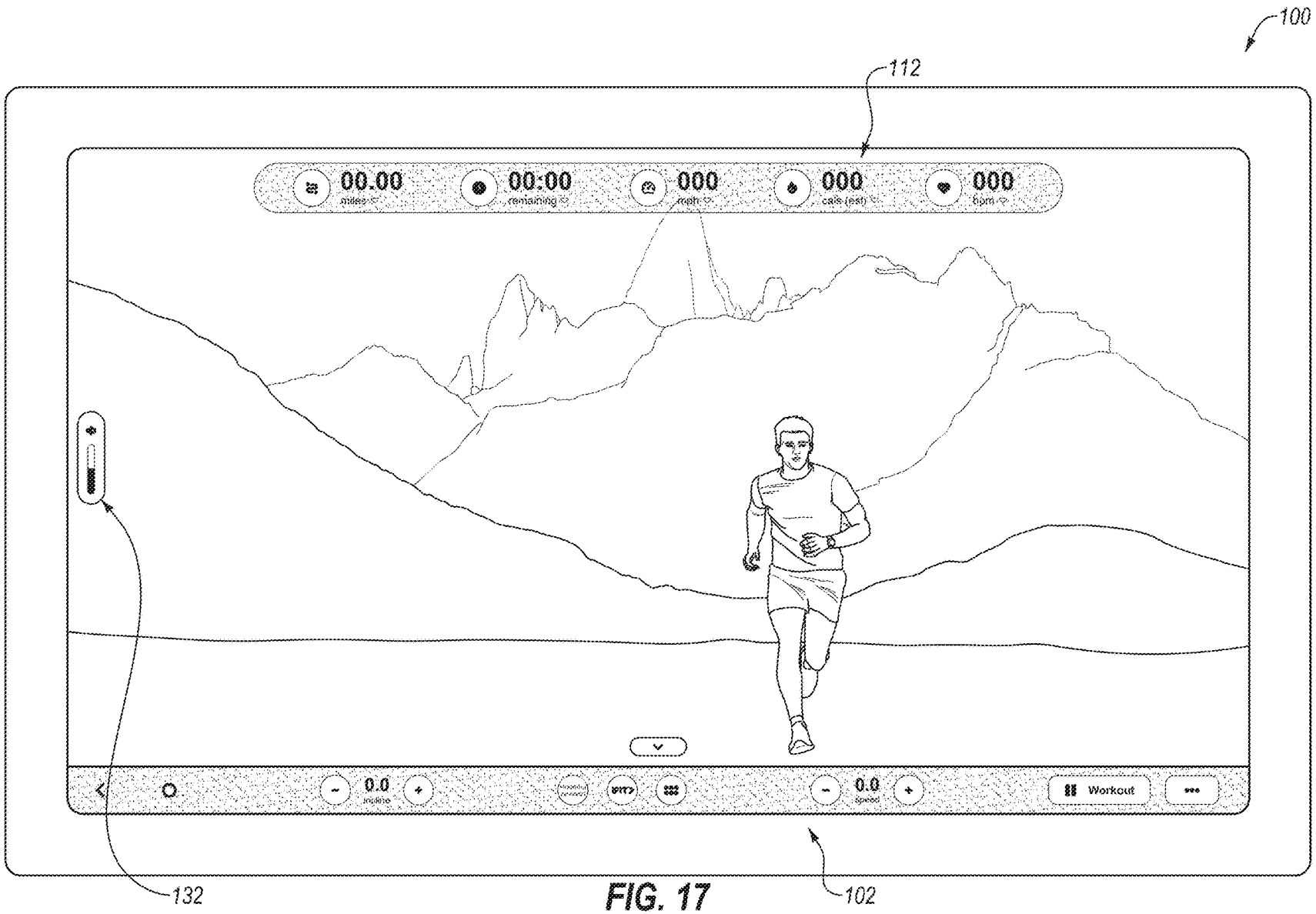
FIG. 17 is a representation of a GUI that may be presented on a display of an exercise device, according to at least one embodiment of the present disclosure.

FIG. 17 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a volume icon 132 is presented on a left side of the display. The volume icon 132 may be representative of any volume. For example, the volume icon 132 may be representative of the total display volume, the volume of the exercise program, the volume of the third-party media, the volume of music, any other volume, and combinations thereof. In some embodiments, the volume may be a representation of a relative volume between the exercise program and third party media.

Figure 18:
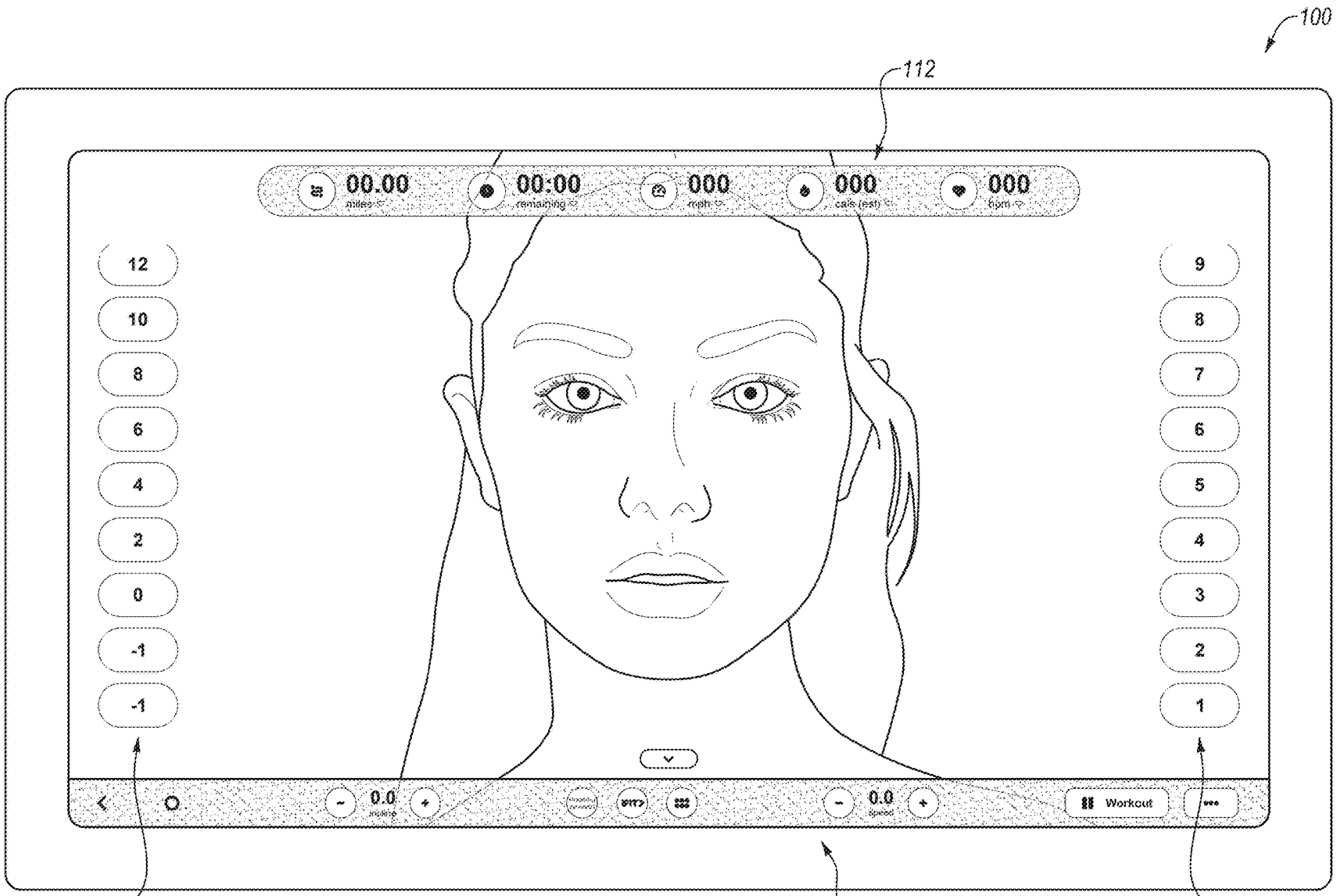
FIG. 18 is a representation of a GUI that may be presented on a display of an exercise device, according to at least one embodiment of the present disclosure.

FIG. 18 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, manual controls for the exercise device are presented overlaid over the background video. The manual controls may include incline controls 134 and speed controls 136. The incline controls 134 and the speed controls 136 may be sliders to present additional information or selectable options for the user. Presenting the incline controls 134 and the speed controls 136 overlaid over the background video may facilitate the user adjusting the operation of the exercise device while playing the media and/or exercise program on the display (e.g., without interrupting the media and/or the exercise program).

Figure 19:
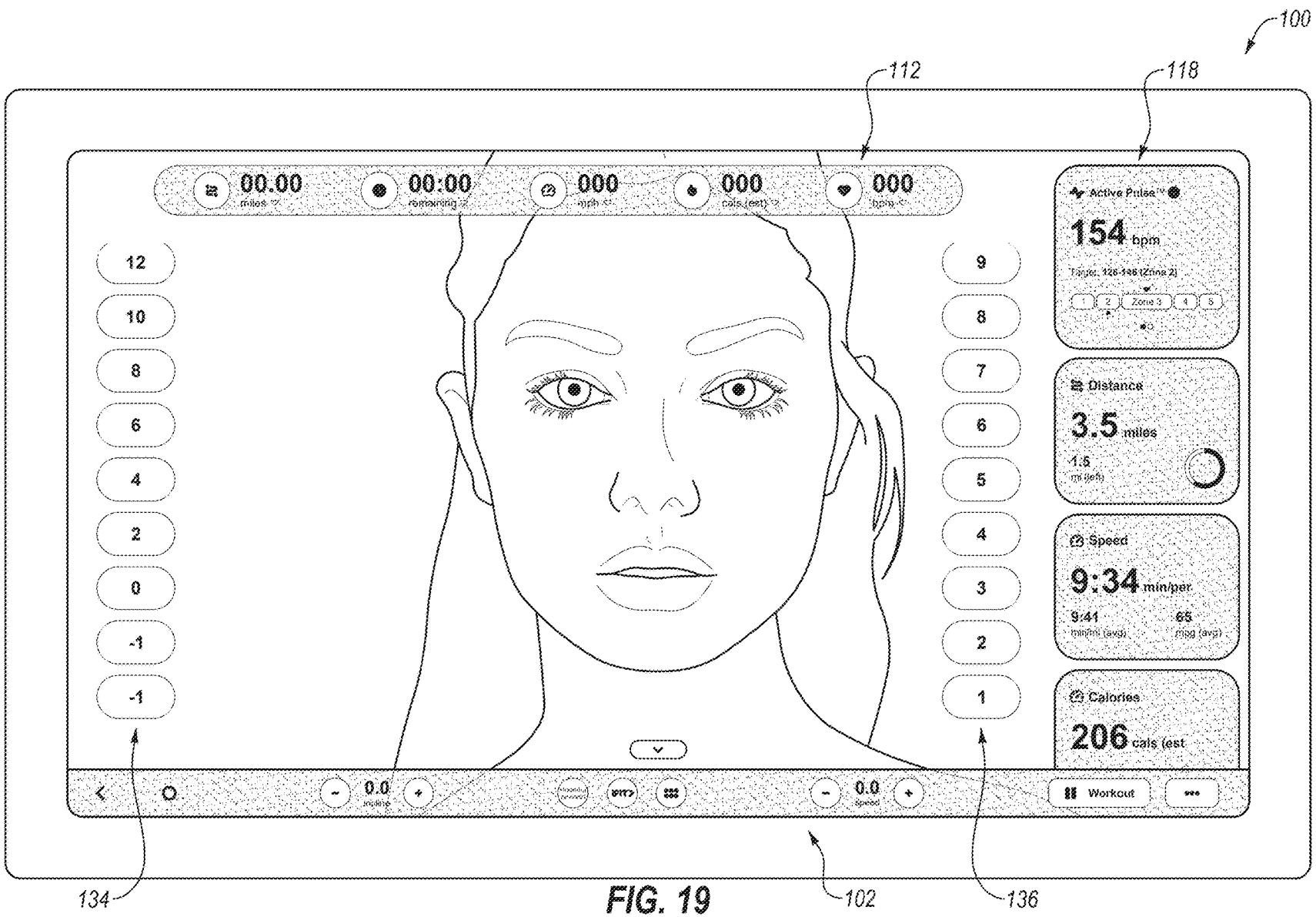
FIG. 19 is a representation of a GUI that may be presented on a display of an exercise device, according to at least one embodiment of the present disclosure.

FIG. 19 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, manual controls for the exercise device are presented overlaid over the background video. The manual controls may include incline controls 134 and speed controls 136. The incline controls 134 and the speed controls 136 may be sliders to present additional information or selectable options for the user. Presenting the incline controls 134 and the speed controls 136 overlaid over the background video may facilitate the user adjusting the operation of the exercise device while playing the media and/or exercise program on the display (e.g., without interrupting the media and/or the exercise program). In the embodiment shown, multiple widgets 118 are overlaid over the background display. Presentation of the widgets 118 has pushed the top banner 112 to the left to allow both the widget 118 and all of the elements or icons of the top banner 112 to be shown. The widgets 118 have also pushed the speed controls 136 to the left to allow both the widgets 118 and the speed controls 136 to both be accessed at the same time. The widgets 118 may include any type of information, including heartrate and/or heartrate zone information, distance, speed, calories burnt, and so forth.

Figure 20:
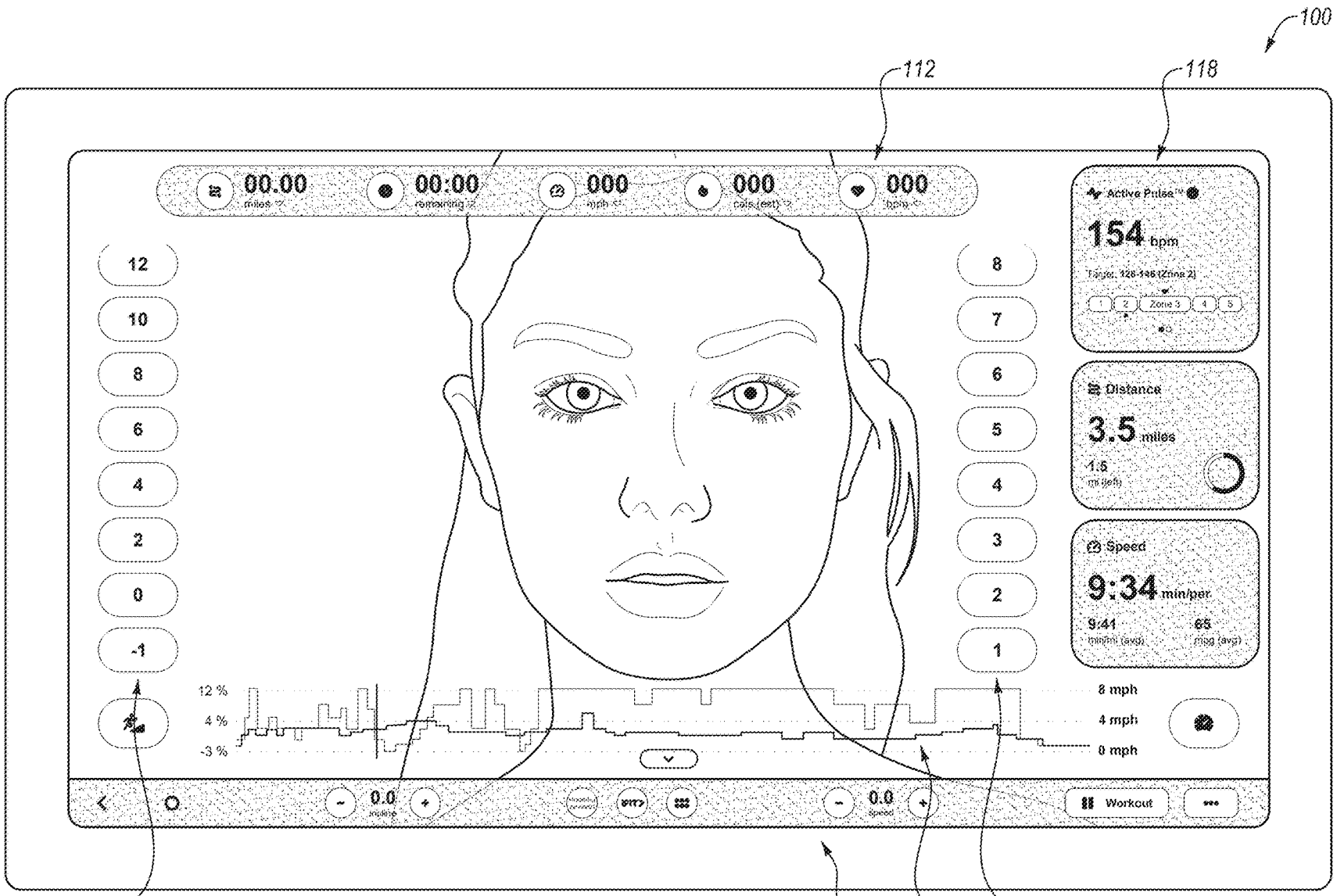
FIG. 20 is a representation of a GUI that may be presented on a display of an exercise device, according to at least one embodiment of the present disclosure.

FIG. 20 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, manual controls for the exercise device are presented overlaid over the background video. The manual controls may include incline controls 134 and speed controls 136. The incline controls 134 and the speed controls 136 may be sliders to present additional information or selectable options for the user. Presenting the incline controls 134 and the speed controls 136 overlaid over the background video may facilitate the user adjusting the operation of the exercise device while playing the media and/or exercise program on the display (e.g., without interrupting the media and/or the exercise program). In the embodiment shown, multiple widgets 118 are overlaid over the background display. Presentation of the widgets 118 has pushed the top banner 112 to the left to allow both the widget 118 and all of the elements or icons of the top banner 112 to be shown. The widgets 118 have also pushed the speed controls 136 to the left to allow both the widgets 118 and the speed controls 136 to both be accessed at the same time. The widgets 118 may include any type of information, including heartrate and/or heartrate zone information, distance, speed, calories burnt, and so forth. In the embodiment shown, a chart 124 is overlaid over the background display above the lower menu 102. The chart 124 may include information associated with the exercise program, such as incline and/or speed. Multiple parameters may be illustrated on the chart 124.

Figure 21:
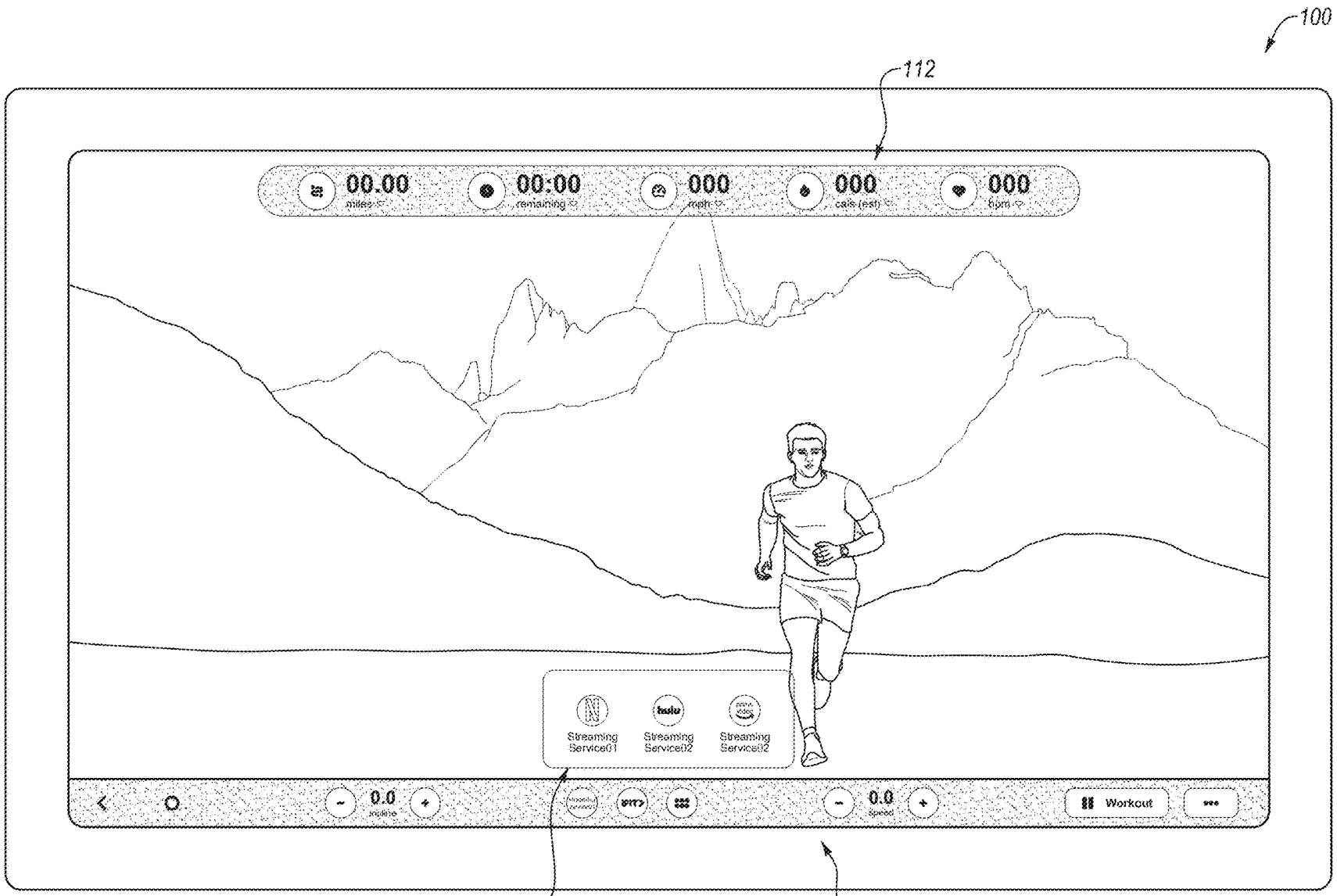
FIG. 21 is a representation of a GUI that may be presented on a display of an exercise device, according to at least one embodiment of the present disclosure.

FIG. 21 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a media selection menu 138 may include a plurality of selectable icons representing third-party media providers. While implementing the exercise program and/or other third-party media, the user may select one of the third-parti media providers from the media selection menu 138 to identify new third-party media to watch.

Figure 22:
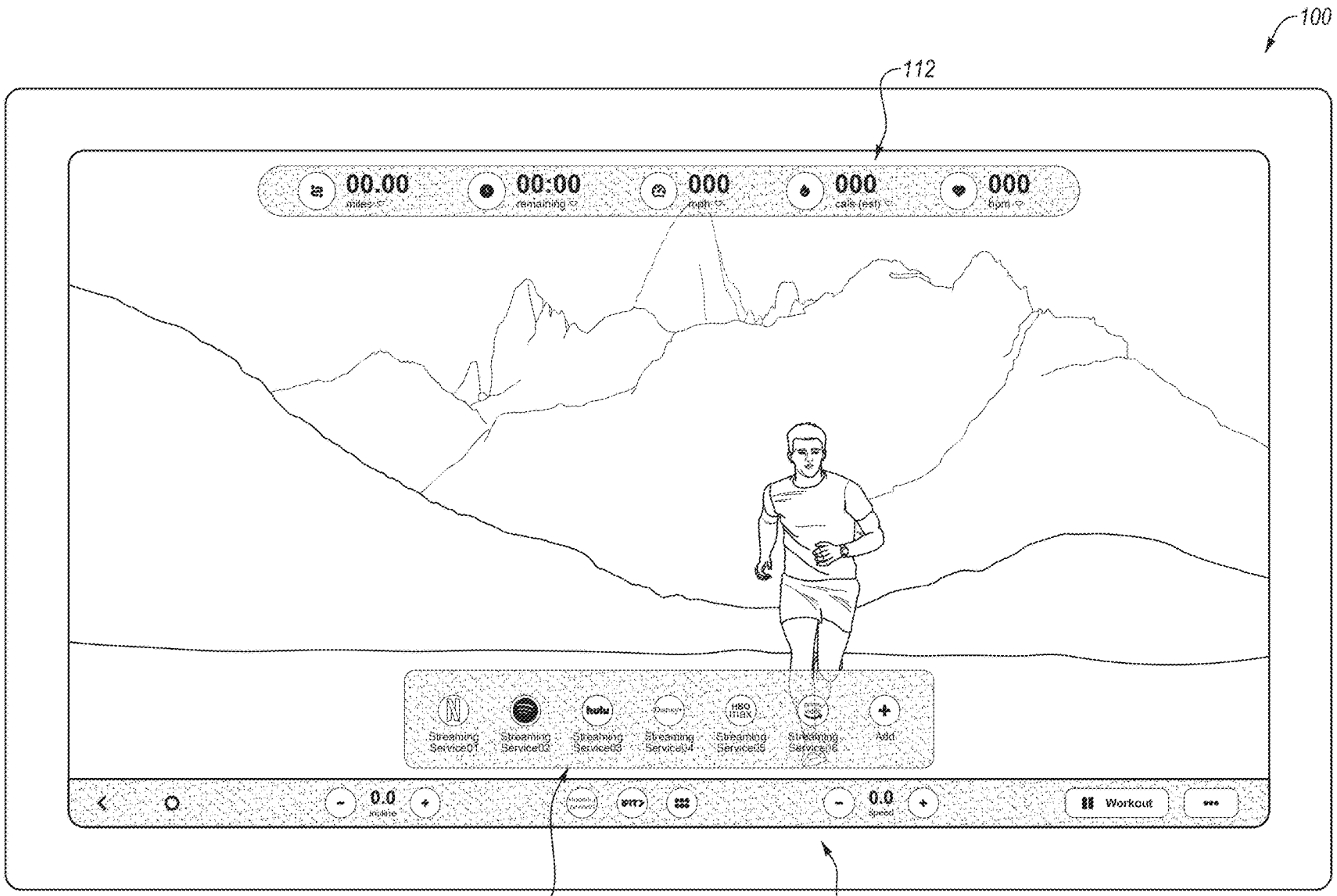
FIG. 22 is a representation of a GUI that may be presented on a display of an exercise device, according to at least one embodiment of the present disclosure.

FIG. 22 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a media selection menu 138 may include a plurality of selectable icons representing third-party media providers. While implementing the exercise program and/or other third-party media, the user may select one of the third-parti media providers from the media selection menu 138 to identify new third-party media to watch.

Figure 23:
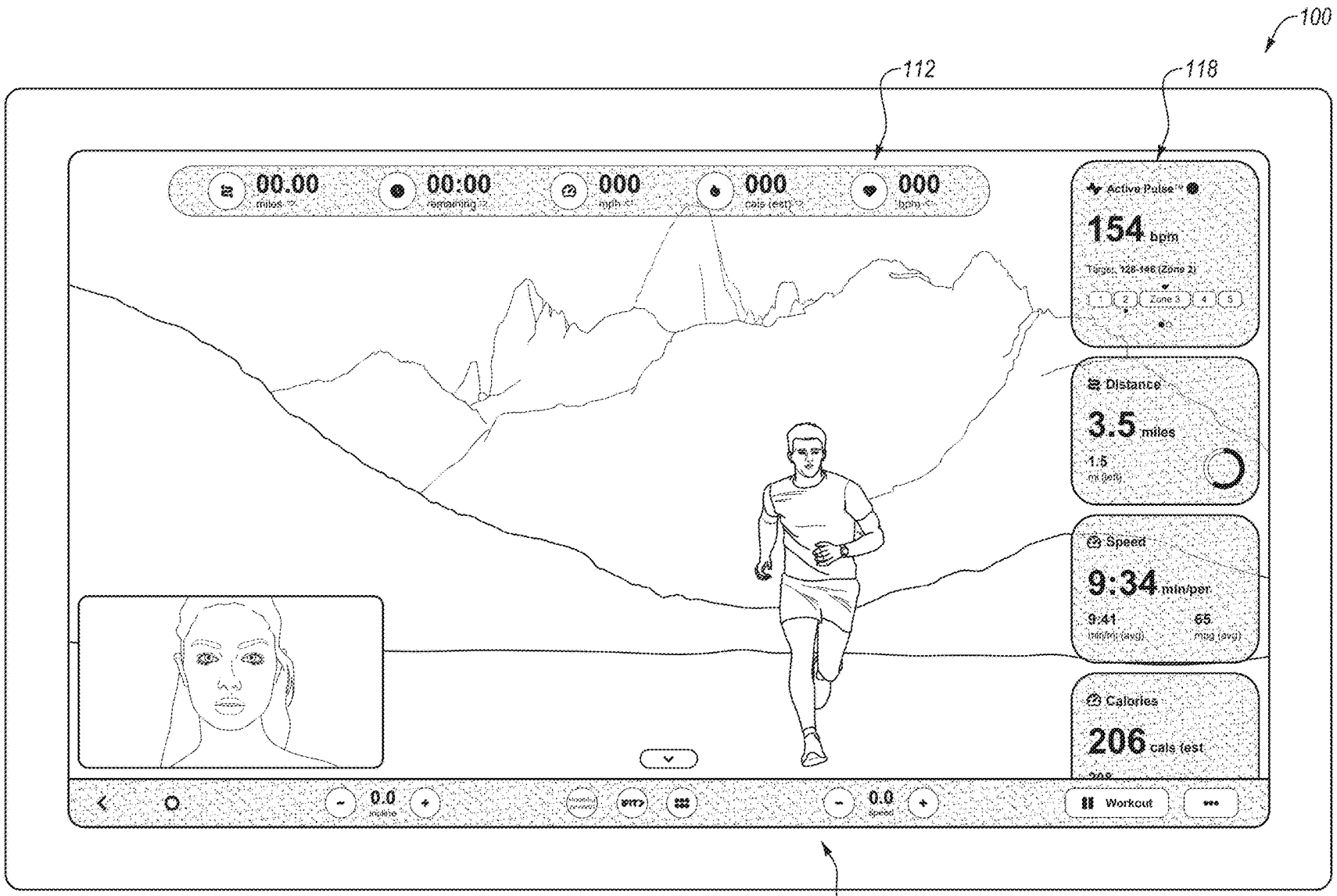
FIG. 23 is a representation of a GUI that may be presented on a display of an exercise device, according to at least one embodiment of the present disclosure.

FIG. 23 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a media selection menu 138 may include a plurality of selectable icons representing third-party media providers. While implementing the exercise program and/or other third-party media, the user may select one of the third-parti media providers from the media selection menu 138 to identify new third-party media to watch.

Figure 24:
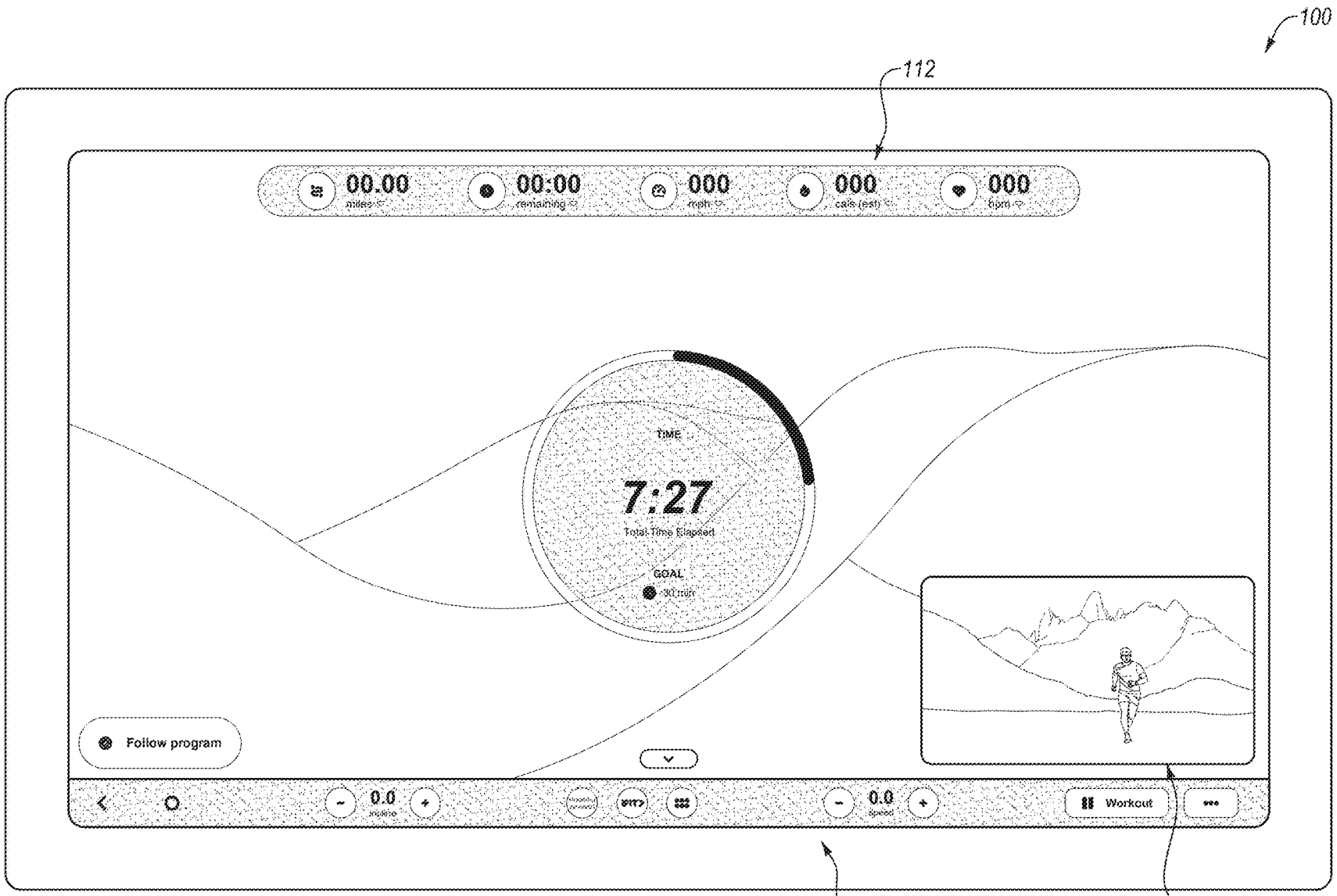
FIG. 24 is a representation of a GUI that may be presented on a display of an exercise device, according to at least one embodiment of the present disclosure.

FIG. 24 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a picture-in-a-picture 140 icon is displayed overlaid over the background. The picture-in-a-picture 140 may illustrate third-party media or the video portion of an exercise program.

Figure 25:
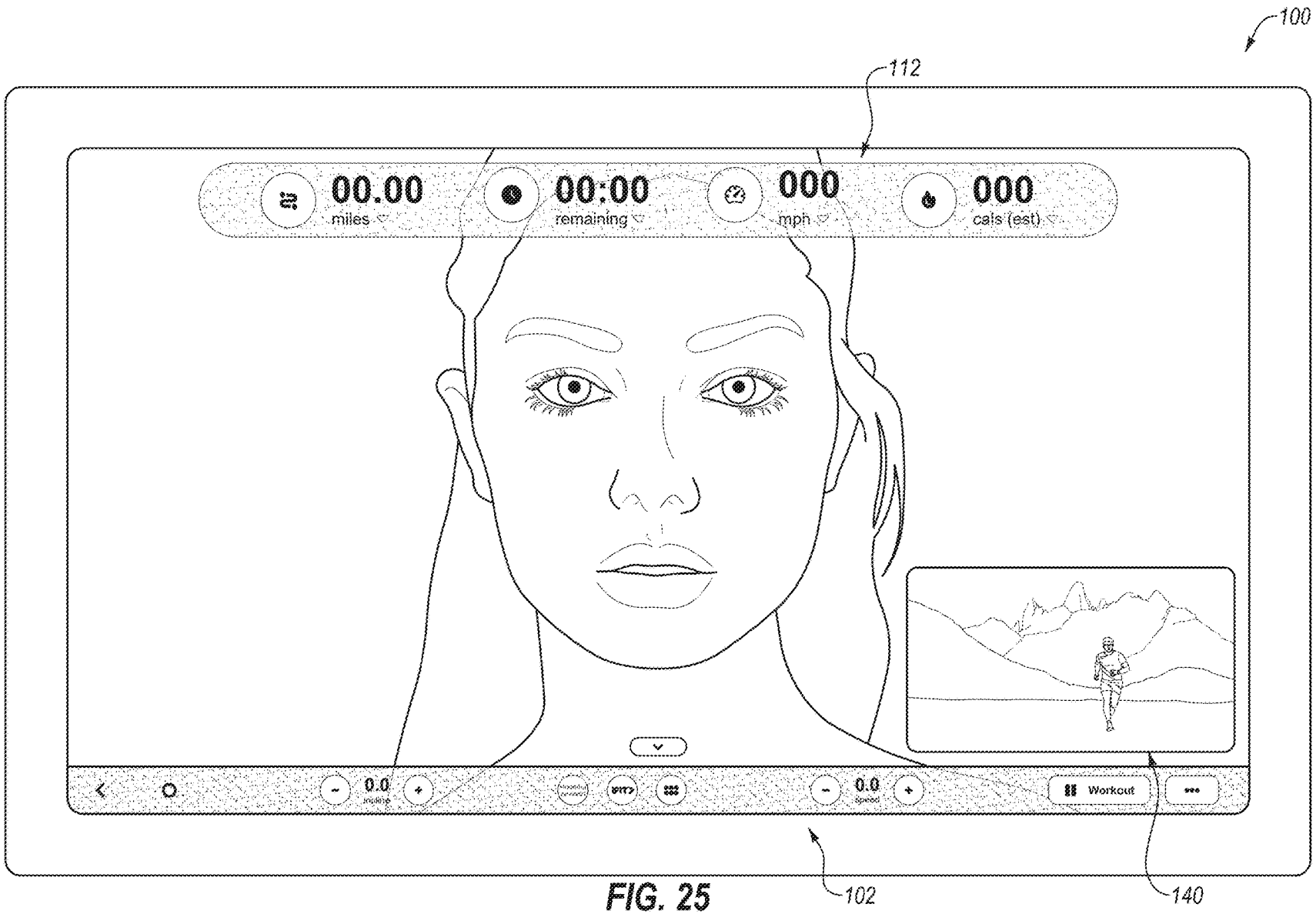
FIG. 25 is a representation of a GUI that may be presented on a display of an exercise device, according to at least one embodiment of the present disclosure.

FIG. 25 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a picture-in-a-picture 140 icon is displayed overlaid over the background.

The picture-in-a-picture 140 may illustrate third-party media or the video portion of an exercise program.

Figure 26:
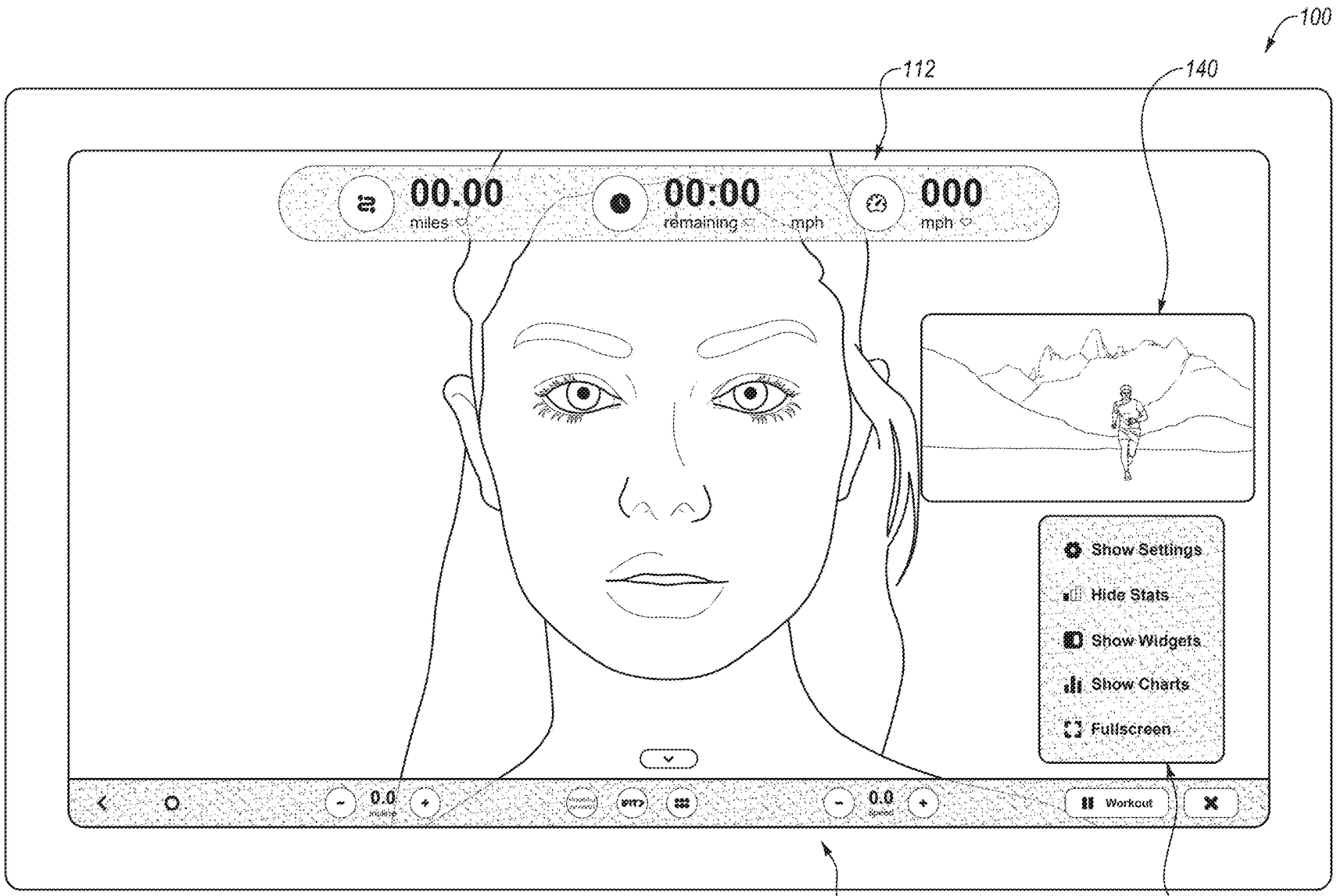
FIG. 26 is a representation of a GUI that may be presented on a display of an exercise device, according to at least one embodiment of the present disclosure.

FIG. 26 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a picture-in-a-picture 140 icon is displayed overlaid over the background. The picture-in-a-picture 140 may illustrate third-party media or the video portion of an exercise program. In the embodiment shown, a settings menu 114 may be overlaid over the video display. The settings menu 114 may be invoked or presented based on the selection of a selectable icon. The settings menu 114 may allow the user to change one or more settings of the GUI 100, such as the presentation of one or more of settings, statistics, widgets, charts, and fullscreen mode. The settings menu 114 may move the picture-in-a-picture 140 upwards.

Figure 27:
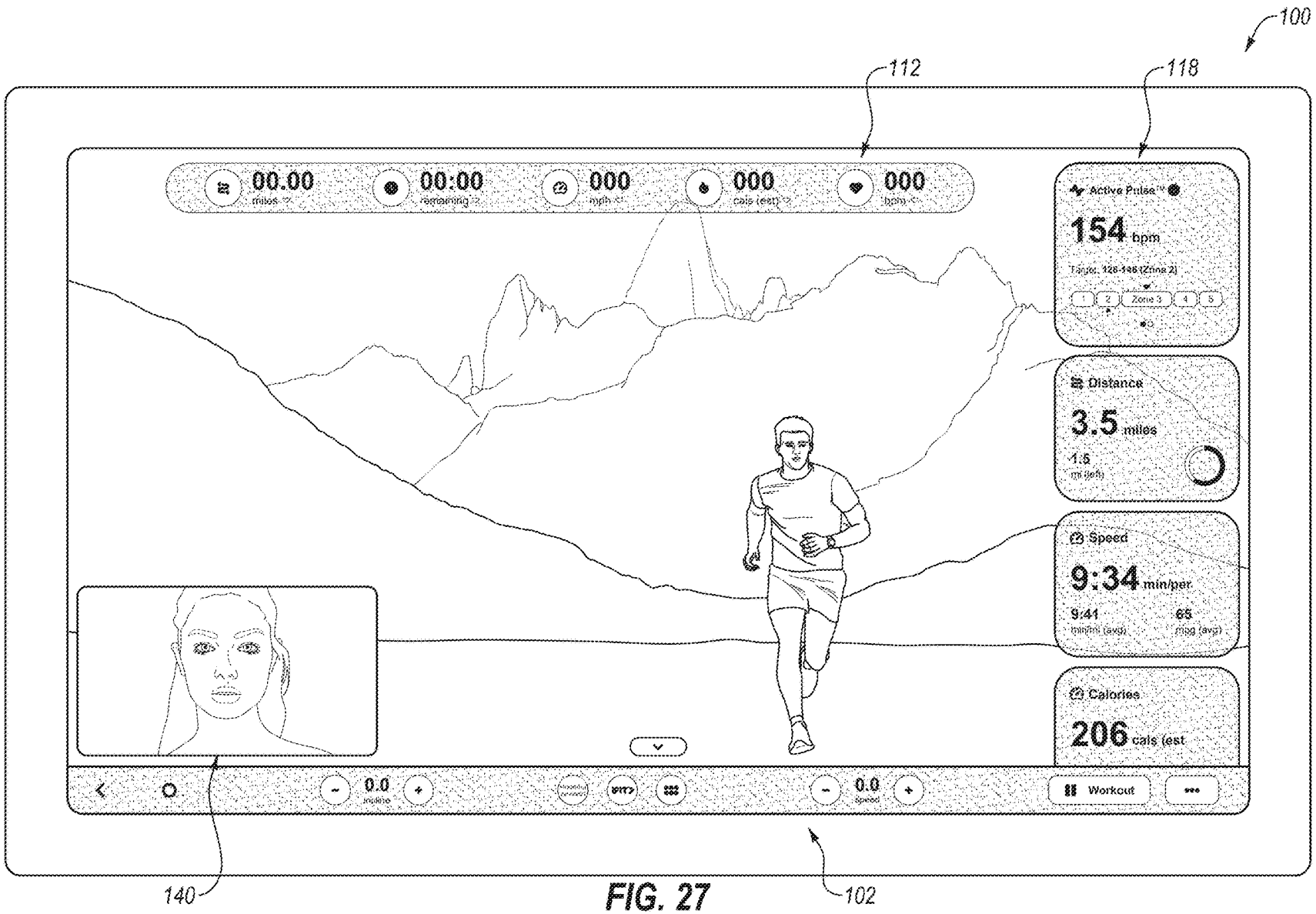
FIG. 27 is a representation of a GUI that may be presented on a display of an exercise device, according to at least one embodiment of the present disclosure.

FIG. 27 is a representation of a GUI 100 that may be presented on a display of an exercise device, according to at least one embodiment of the present disclosure. The GUI 100 may include a background image or video display, with a lower menu 102 and a top banner 112 overlaid over the video display. In the embodiment shown, a picture-in-a-picture 140 icon is displayed overlaid over the background. The picture-in-a-picture 140 may illustrate third-party media or the video portion of an exercise program. In the embodiment shown, multiple widgets 118 are overlaid over the background display. Presentation of the widgets 118 has pushed the top banner 112 to the left to allow both the widget 118 and all of the elements or icons of the top banner 112 to be shown.

Figure 28:
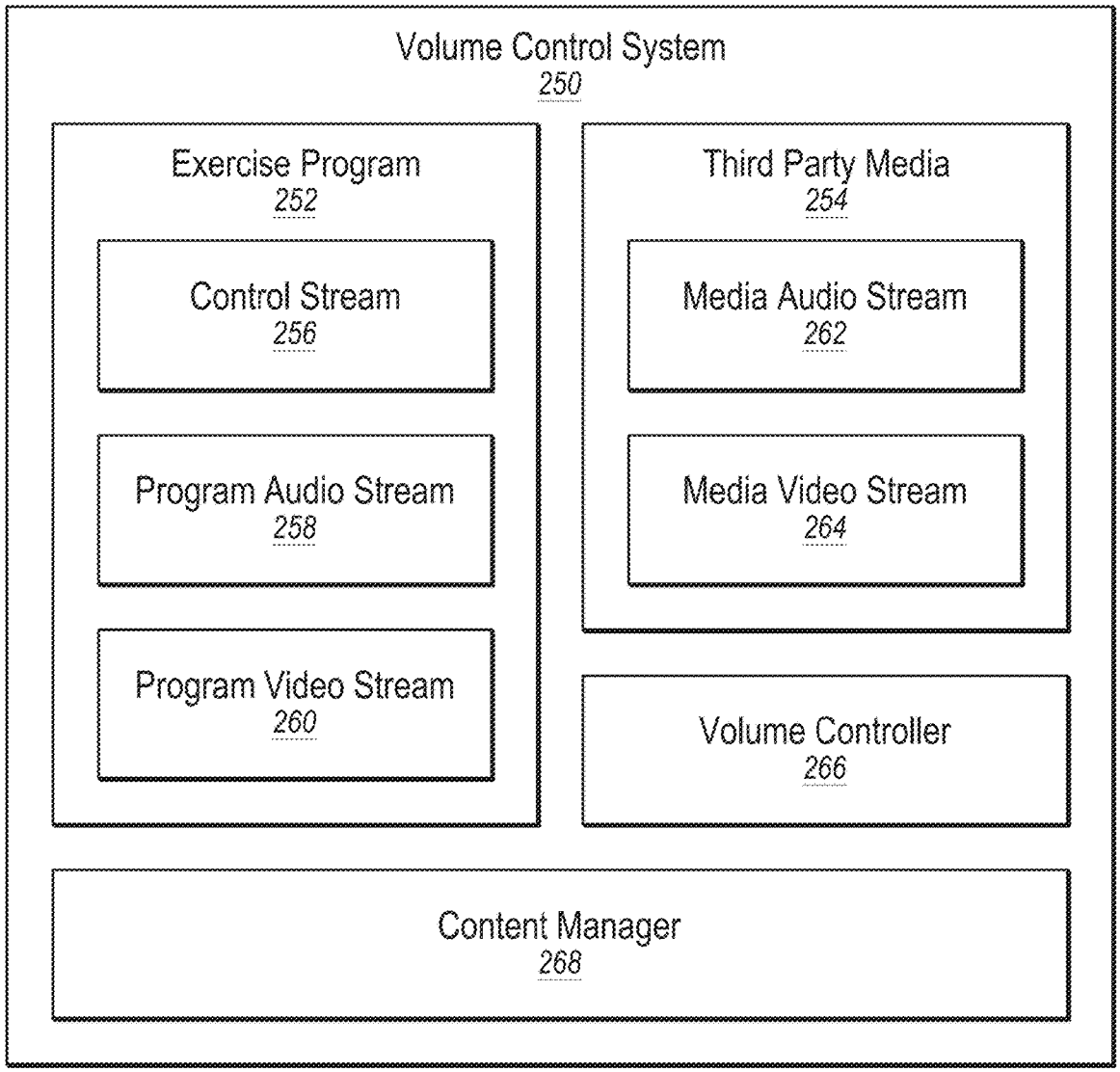
FIG. 28 is a representation of a volume control system, according to at least one embodiment of the present disclosure.

FIG. 28 is a representation of a volume control system 250, according to at least one embodiment of the present disclosure. Each of the components of the volume control system 250 can include software, hardware, or both. For example, the components can include one or more instructions stored on a computer-readable storage medium and executable by processors of one or more computing devices, such as a client device or server device. When executed by the one or more processors, the computer-executable instructions of the volume control system 250 can cause the computing device(s) to perform the methods described herein. Alternatively, the components can include hardware, such as a special-purpose processing device to perform a certain function or group of functions. Alternatively, the components of the volume control system 250 can include a combination of computer-executable instructions and hardware.

Furthermore, the components of the volume control system 250 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The volume control system 250 may control the volume of the sound output of an exercise program. For example, the volume control system 250 may control the volume of an exercise program package 252 and third-party media 254. The exercise program package 252 may include a control stream 256, a program audio stream 258, and a program video stream 260. The control stream 256 may include exercise device controls that may cause the exercise device to adjust one or more operating parameters of the exercise device. The exercise device controls of the control stream 256 may adjust any operating parameter of the exercise device. For example, the exercise device controls of the control stream 256 may adjust operating parameters including one or more of speed, incline, resistance, and so forth.

The program audio stream 258 includes audio associated with the exercise program package 252 and the program video stream 260 includes video associated with the exercise program package 252. The program audio stream 258 and the program video stream 260 may include representations of audiovisual elements associated with performing the exercise program. For example, the program audio stream 258 may include music, sound effects, trainer dialog, any other audio associated with the exercise program package 252, and combinations thereof. The program video stream 260 may include video associated with the exercise program package 252, such as video of the trainer, an actor, a simulated environment, the user, an avatar of the user, avatars of other users, pre-recorded video of real-life locations, any other video associated with the exercise program package 252, and combinations thereof.

The control stream 256, program audio stream 258, and program video stream 260 may be synchronized. For example, changes in operating parameters represented by the exercise device controls may be synchronized or occur at the same time as audio content from the program audio stream 258 and video content from the program video stream 260. In some embodiments, elements from the control stream 256, the program audio stream 258, and the program video stream 260 may be related. For example, a trainer may discuss and/or show a user regarding a change in the operating parameters in the exercise device when the exercise device controls cause an associated change in the operating parameters of the user's exercise device.

The third-party media 254 includes a media audio stream 262 and a media video stream 264. The third-party media 254 may be any third-party media. For example, the third-party media 254 may include one or more of television shows, movies, cartoons, animations, music, any other third-party media, and combinations thereof. The third-party media 254 may be provided in any manner. For example, the third-party media 254 may be streamed from a streaming service, stored on local memory, cast from a third-party device (such as a user's mobile device), any other source, and combinations thereof. In some embodiments, the media audio stream 262 may be unrelated to the exercise program package 252. For example, the media audio stream 262 may be unrelated to the program audio stream 258 and/or the program video stream 260.

The volume control system 250 further includes a volume controller 266. The volume controller 266 may control the volume of the media audio stream 262 and the program audio stream 258. In some embodiments, the volume controller 266 may cause the audio of the media audio stream 262 and the program audio stream 258 to be played simultaneously. For example, the volume controller 266 may cause the exercise device to play both the media audio stream 262 and the program audio stream 258 while the exercise device is implementing the exercise program package 252. This may allow the user to exercise using the exercise program package 252 while watching and listening to the third-party media 254.

In accordance with at least one embodiment of the present disclosure, the volume controller 266 may adjust a relative volume between the media audio stream 262 and the program audio stream 258. The relative volume may be a representation of the total volume for the media audio stream 262 and the program audio stream 258 played by the exercise device. For example, a relative volume of 50% may indicate that the media audio stream 262 and the program audio stream 258 both represent an equal share in the total volume played out of the speakers. A relative volume of 70% for the program audio stream 258 may indicate that the program audio stream 258 may represent 70% of the total volume played out of the speakers and the media audio stream 262 may represent 30% of the total volume played out of the speakers. In some embodiments, the relative volume may be based on the maximum decibels played out of the speakers at a particular volume level. In some embodiments, the relative volume may be based on pre-determined volume levels of the program audio stream 258 and the media audio stream 262.

In some embodiments, the volume controller 266 may set the relative volume based on the pre-determined settings. For example, the exercise program package 252 may include pre-determined settings for the program audio stream 258 to prioritize the volume of the exercise program package 252 over the third-party media 254. In some examples, the third-party media 254 may include pre-determined settings for the media audio stream 262 to prioritize the volume of the third-party media 254 over the exercise program package 252. In some embodiments, the user may set the relative volume. For example, the user (using a selectable icon, such as the volume icon 132 and/or the media settings menu 116) may set the relative volume based on the user's preferences. For example, the user may prefer to prioritize the third-party media 254, allowing the user to focus on the third-party media 254 and not on the exercise program package 252. In some examples, the user may prefer to prioritize the exercise program package 252, allowing the user to focus on the exercise program package 252 and not on the third-party media 254.

In accordance with at least one embodiment of at least one embodiment of the present disclosure, the volume control system 250 may include a content manger 268. The content manger 268 may adjust the relative volume of the program audio stream 258 and the media audio stream 262 based on content of the exercise program package 252. For example, the exercise program package 252 may include content that the volume control system 250 and/or the user may desire to be prioritized. For such priority content, the content manger 268 may alter the relative volume of the program audio stream 258 and the media audio stream 262. For example, the content manger 268 may cause the program audio stream 258 to receive a higher relative volume than the media audio stream 262. This may facilitate the user receiving the priority content in the exercise program package 252.

The content manger 268 may alter the relative volume in any manner. For example, the content manger 268 may invert the relative volume (e.g., 70% media audio stream 262 and 30% program audio stream 258 inverted to 30% program audio stream 258 and 30% media audio stream 262). In some examples, the content manger 268 may increase the relative volume of the program audio stream 258 by a pre-determined amount (e.g., decrease the volume of the media audio stream 262 or increasing the relative volume of the program audio stream 258 by 10%, 20%, 30%, 40%, 50%, 60%, 70%, 80%, 90%, or any value therebetween). In some examples, the content manger 268 may increase the relative volume of the program audio stream 258 to 100% (e.g., mute the media audio stream 262). In some examples, the content manger 268 may pause the media audio stream 262.

In some embodiments, the content manger 268 may alter the relative volume based on user input. For example, the user may provide an input (using a selectable icon, such as the volume icon 132 and/or the media settings menu 116) to determine the amount of alteration to the relative volume by the content manger 268. In some embodiments, the content manger 268 may alter the relative volume based on manufacturer specifications and/or industry regulations.

The content manger 268 may alter the relative volume based on content in the exercise program package 252. The content in the exercise program package 252 may include any content. For example, the content in the exercise program package 252 may include a change in one or more exercise parameters of the exercise device. In some examples, the content in the exercise program package 252 may include a change in exercise type (e.g., stepping off the exercise device to perform a different exercise, transition to a second exercise device). In some examples, the content in the exercise program package 252 may include trainer dialog in the program audio stream 258. In some examples, the content in the exercise program package 252 may include a particular image or video stream in the program video stream 260.

In some examples, the content of the exercise program package 252 that causes the content manger 268 to alter the relative volume may include a metadata tag stored in metadata for the exercise program package 252. For example, the metadata tag may be included in a separate metadata file. In some examples, the metadata tag may be included in the control stream 256. In some examples, the metadata tag may be included in the program video stream 260. In some embodiments, the metadata tag may include an instruction to the content manger 268 to alter the relative volume. The metadata tag may be synchronized to a particular time in the exercise program package 252. For example, the metadata tag may be associated with a particular time of the exercise program package 252 and the content of the control stream 256, the program audio stream 258, the program video stream 260, and combinations thereof.

In some examples, the metadata tag may include an urgency. The urgency may be a representation of the priority of the change in relative volume. For example, the content manger 268 may include an urgency threshold to adjust the relative volume. The urgency threshold may be based on user preferences, manufacturer standards, industry standards or regulations, and so forth. If the urgency of the metadata tag exceeds the urgency threshold then the content manger 268 may alter the relative volume of the program audio stream 258 and the media audio stream 262. In some embodiments, the urgency of the metadata tag may be associated with the extent of the change in the relative volume. For example, a lower urgency may be associated with a lower change in the relative volume. A higher urgency may be associated with a higher change in the relative volume. This may prioritize higher urgency content in the exercise program package 252. In some embodiments, the user may change the urgency threshold and/or the change in relative volume for a particular content urgency.

Figure 29:
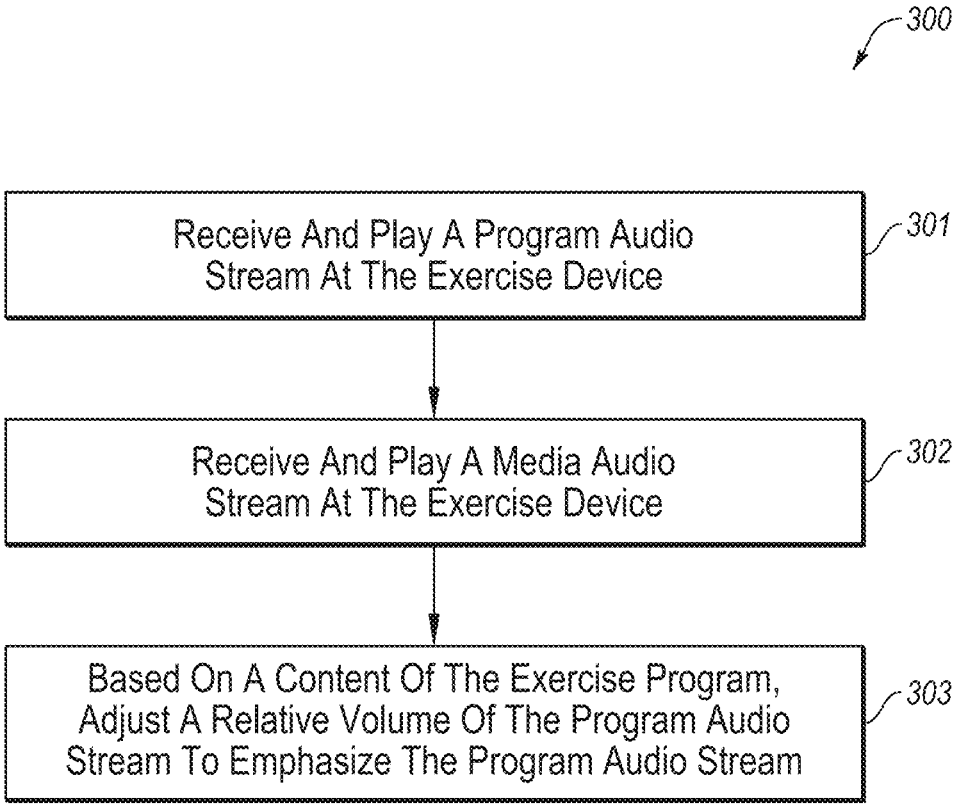
FIG. 29 is a flowchart of a method for controlling an exercise device, according to at least one embodiment of the present disclosure.
Figure 30:
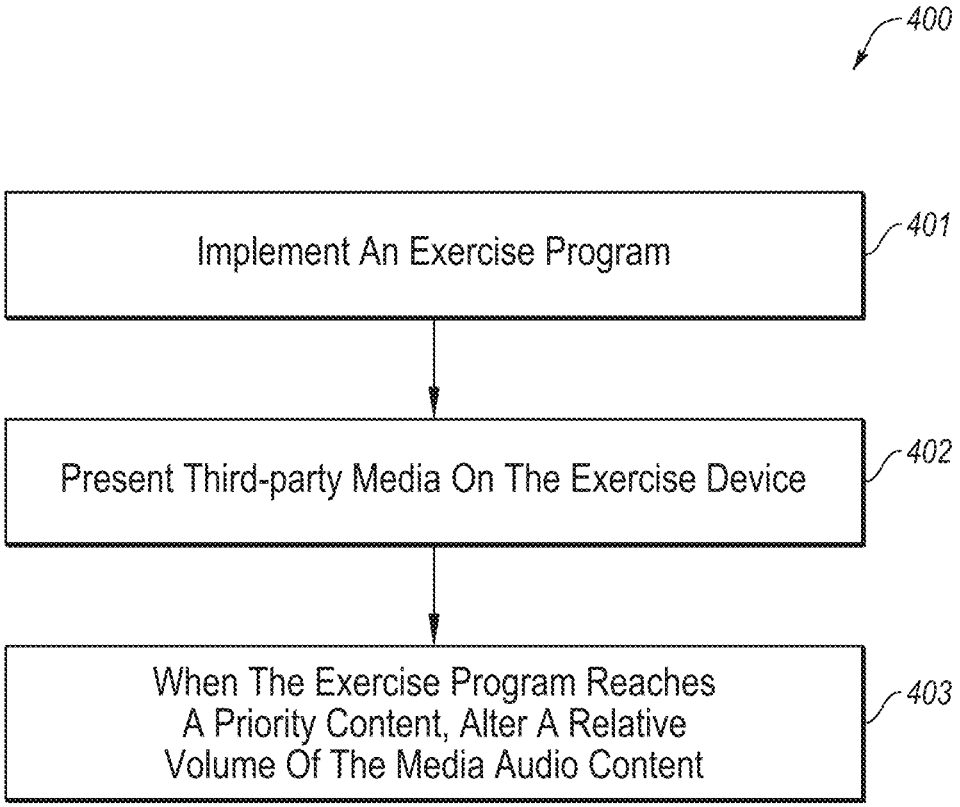
FIG. 30 is a flowchart of a method for controlling an exercise device, according to at least one embodiment of the present disclosure.
Figure 31:
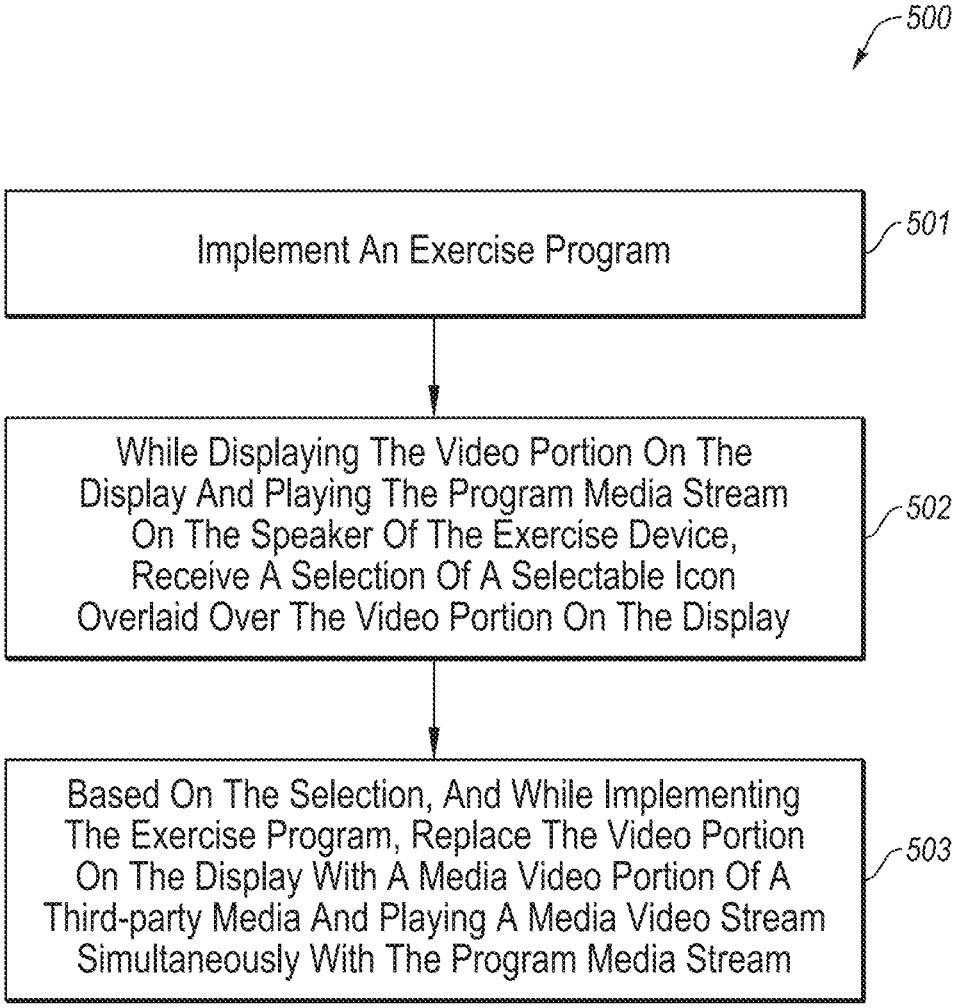
FIG. 31 is a flowchart of a method for controlling an exercise device, according to at least one embodiment of the present disclosure.

FIG. 29 through FIG. 31, the corresponding text, and the examples provide a number of different methods, systems, devices, and computer-readable media of the volume control system 250. In addition to the foregoing, one or more embodiments can also be described in terms of flowcharts comprising acts for accomplishing a particular result, as shown in FIG. 29 through FIG. 31. FIG. 29 through FIG. 31 may be performed with more or fewer acts. Further, the acts may be performed in differing orders. Additionally, the acts described herein may be repeated or performed in parallel with one another or parallel with different instances of the same or similar acts.

As mentioned, FIG. 29 illustrates a flowchart of a series of acts or a method 300 for controlling an exercise device, according to at least one embodiment of the present disclosure. While FIG. 29 illustrates acts according to one embodiment, alternative embodiments may omit, add to, reorder, and/or modify any of the acts shown in FIG. 29. The acts of FIG. 29 can be performed as part of a method. Alternatively, a computer-readable medium can comprise instructions that, when executed by one or more processors, cause a computing device to perform the acts of FIG. 29. In some embodiments, a system can perform the acts of FIG. 29.

A volume control system may receive and play a program audio stream at an exercise device at 301. The program audio stream may be played with a program volume. The program volume may be the absolute volume of the program audio stream as heard by the user. The program audio stream is part of an exercise program. The exercise program includes exercise device controls that adjust an operating parameter of the exercise device. The program audio stream is synchronized with the exercise device controls.

The volume control system may receive and play a media audio stream at the exercise device at 302. The media audio stream is played with a media volume. The media volume may be the absolute volume of the media audio stream as heard by the user. Based on a content of the exercise program, the volume control system adjust a relative volume of the program audio stream to emphasize the program audio stream at 303. The relative volume may be the ratio of the program volume to the media volume, or the percentage of the program volume and the percentage of the media volume relative to the total volume played from the speakers of the exercise device. In some examples, emphasizing the program audio stream may include increasing the relative volume of the program audio stream (e.g., increasing the relative volume of the program volume). In some examples, emphasizing the program audio stream may include decreasing the relative volume of the media audio stream (e.g., decreasing the relative volume of the media volume).

As mentioned, FIG. 30 illustrates a flowchart of a series of acts or a method 400 for controlling an exercise device, according to at least one embodiment of the present disclosure. While FIG. 30 illustrates acts according to one embodiment, alternative embodiments may omit, add to, reorder, and/or modify any of the acts shown in FIG. 30. The acts of FIG. 30 can be performed as part of a method. Alternatively, a computer-readable medium can comprise instructions that, when executed by one or more processors, cause a computing device to perform the acts of FIG. 30. In some embodiments, a system can perform the acts of FIG. 30.

An exercise device may implement an exercise program on the exercise device at 401. The exercise program includes exercise device controls that adjust an operating parameter of the exercise device. The exercise program further includes a program video stream and a program audio stream. The program video stream and the program audio stream are synchronized with the exercise device controls. The program audio stream is played through speakers on the exercise device. The exercise device may present third-party media on the exercise device at 402. The exercise device may display, on a display of the exercise device, a media video stream of the third-party media and media audio stream through the speakers of the device. When the exercise program reaches a priority content of the exercise program, a volume control system may alter a relative volume of the media audio stream at 403. In some embodiments, at the priority content, the volume control system may suppress the media video stream, such as by pausing the media video stream and/or overlaying a notice, notification, or a portion of the program video stream over the media video stream.

As mentioned, FIG. 31 illustrates a flowchart of a series of acts or a method 500 for controlling an exercise device, according to at least one embodiment of the present disclosure. While FIG. 31 illustrates acts according to one embodiment, alternative embodiments may omit, add to, reorder, and/or modify any of the acts shown in FIG. 31. The acts of FIG. 31 can be performed as part of a method. Alternatively, a computer-readable medium can comprise instructions that, when executed by one or more processors, cause a computing device to perform the acts of FIG. 31. In some embodiments, a system can perform the acts of FIG. 31.

An exercise device may implement an exercise program on the exercise device at 501. The exercise program includes a video portion and a program media stream. The video portion is displayed on a display of the exercise device and the program media stream is played on a speaker of the exercise device. While displaying the video portion on the display and playing the program media stream on the speaker of the exercise device, the exercise device receives a selection of a selectable icon overlaid over the video portion on the display at 502. Based on the selection, and while implementing the exercise program, a volume control system replaces the video portion on the display with a media video portion of a third party media and plays a media video stream simultaneously with the program media stream at 503. This may facilitate improved control over the exercise device and reduced disruptions to the exercise program when implementing the exercise program.

The selection may be any type of selection. For example, the selection may be a volume selection of a volume selectable icon. This may change a relative volume of the media video stream based on the volume selection. In some examples, the selection may be a control selectable icon overlaid over the media video stream. In some examples, the control selection may adjust at least one operating parameter of the exercise device. In some embodiments, the display includes a picture-in-a-picture icon of the video portion over the media video portion displayed on the display.

Figure 32:
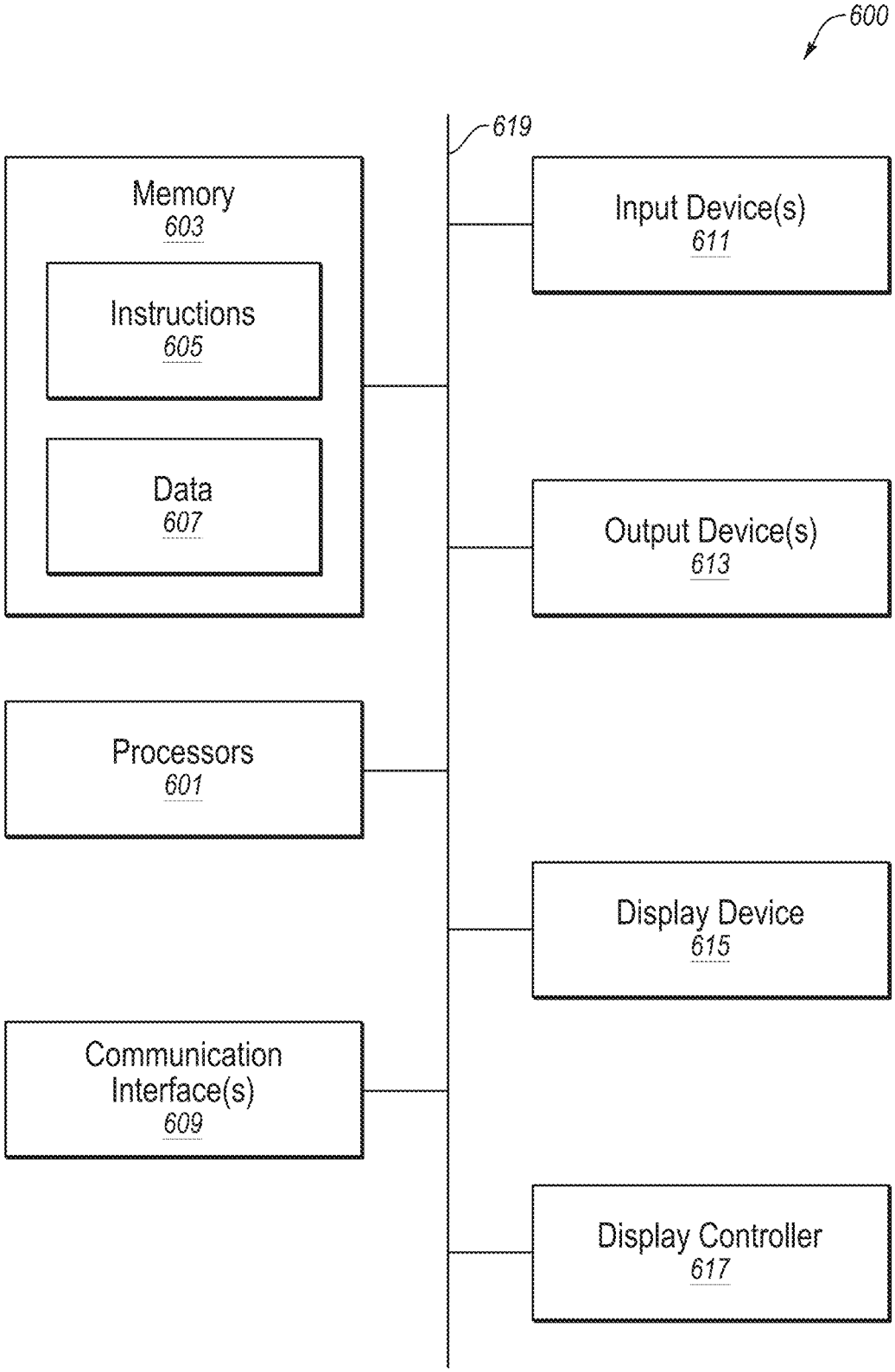
FIG. 32 is a representation of a computing system, according to at least one embodiment of the present disclosure.

FIG. 32 illustrates certain components that may be included within a computer system 600. One or more computer systems 600 may be used to implement the various devices, components, and systems described herein.

The computer system 600 includes a processor 601. The processor 601 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 601 may be referred to as a central processing unit (CPU). Although just a single processor 601 is shown in the computer system 600 of FIG. 6, in an alternative configuration, a combination of processors (e.g., an ARM and DSP) could be used.

The computer system 600 also includes memory 603 in electronic communication with the processor 601. The memory 603 may be any electronic component capable of storing electronic information. For example, the memory 603 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 605 and data 607 may be stored in the memory 603. The instructions 605 may be executable by the processor 601 to implement some or all of the functionality disclosed herein. Executing the instructions 605 may involve the use of the data 607 that is stored in the memory 603. Any of the various examples of modules and components described herein may be implemented, partially or wholly, as instructions 605 stored in memory 603 and executed by the processor 601. Any of the various examples of data described herein may be among the data 607 that is stored in memory 603 and used during execution of the instructions 605 by the processor 601.

A computer system 600 may also include one or more communication interfaces 609 for communicating with other electronic devices. The communication interface(s) 609 may be based on wired communication technology, wireless communication technology, or both. Some examples of communication interfaces 609 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 600 may also include one or more input devices 611 and one or more output devices 613. Some examples of input devices 611 include a keyboard, mouse, microphone, remote control device, button, joystick, trackball, touchpad, and lightpen. Some examples of output devices 613 include a speaker and a printer. One specific type of output device that is typically included in a computer system 600 is a display device 615. Display devices 615 used with embodiments disclosed herein may utilize any suitable image projection technology, such as liquid crystal display (LCD), light-emitting diode (LED), gas plasma, electroluminescence, or the like. A display controller 617 may also be provided, for converting data 607 stored in the memory 603 into text, graphics, and/or moving images (as appropriate) shown on the display device 615.

The various components of the computer system 600 may be coupled together by one or more buses, which may include a power bus, a control signal bus, a status signal bus, a data bus, etc. For the sake of clarity, the various buses are illustrated in FIG. 32 as a bus system 619.

INDUSTRIAL APPLICABILITY

This disclosure generally relates to devices, systems, and methods for controlling an exercise device. A graphical user interface for an exercise device includes one or more selectable icons presented on a video display overlaid over a video (such as third-party media and/or an exercise program). Selection of the selectable icons may facilitate changing of one or more settings of the exercise device. In accordance with at least one embodiment of the present disclosure, selection of the selectable icons may change a setting of the exercise device without interrupting playing of the media on the display. In some embodiments, selection of the selectable icons may display third-party media on the display without interrupting the implementation of the exercise program. This may allow the user to seamlessly select and implement the exercise program and third-party media based on his or her desires and interests.

In accordance with at least one embodiment of the present disclosure, the user may adjust the relative volume of the audio streams of the exercise program and the third-party media. For example, while the user is performing a workout based on the exercise program that the exercise device implements, the user may increase the relative volume of the third-party media and decrease the relative volume of the exercise program. In some embodiments, the exercise device may, based on content of the exercise program, adjust the relative volume of the exercise program to emphasize or highlight the audio stream of the exercise program. This may facilitate the user hearing critical instructions, raising the user's awareness of changes to the operating parameters of the exercise device, and highlighting other portions of the exercise program. In this manner, the safety of the implementation of the exercise device may be increased.

Each of the components of a volume control system can include software, hardware, or both. For example, the components can include one or more instructions stored on a computer-readable storage medium and executable by processors of one or more computing devices, such as a client device or server device. When executed by the one or more processors, the computer-executable instructions of the volume control system can cause the computing device(s) to perform the methods described herein. Alternatively, the components can include hardware, such as a special-purpose processing device to perform a certain function or group of functions. Alternatively, the components of the volume control system can include a combination of computer-executable instructions and hardware.

Furthermore, the components of the volume control system may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The volume control system may control the volume of the sound output of an exercise program. For example, the volume control system may control the volume of an exercise program and third-party media. The exercise program may include a control stream, a program audio stream, and a program video stream. The control stream may include exercise device controls that may cause the exercise device to adjust one or more operating parameters of the exercise device. The exercise device controls of the control stream may adjust any operating parameter of the exercise device. For example, the exercise device controls of the control stream may adjust operating parameters including one or more of speed, incline, resistance, and so forth.

The program audio stream includes audio associated with the exercise program and the program video stream includes video associated with the exercise program. The program audio stream and the program video stream may include representations of audiovisual elements associated with performing the exercise program. For example, the program audio stream may include music, sound effects, trainer dialog, any other audio associated with the exercise program, and combinations thereof. The program video stream may include video associated with the exercise program, such as video of the trainer, an actor, a simulated environment, the user, an avatar of the user, avatars of other users, pre-recorded video of real-life locations, any other video associated with the exercise program, and combinations thereof.

The control stream, program audio stream, and program video stream may be synchronized. For example, changes in operating parameters represented by the exercise device controls may be synchronized or occur at the same time as audio content from the program audio stream and video content from the program video stream. In some embodiments, elements from the control stream, the program audio stream, and the program video stream may be related. For example, a trainer may discuss and/or show a user regarding a change in the operating parameters in the exercise device when the exercise device controls cause an associated change in the operating parameters of the user's exercise device.

The third-party media includes a media audio stream and a media video stream. The third-party media may be any third-party media. For example, the third-party media may include one or more of television shows, movies, cartoons, animations, music, any other third-party media, and combinations thereof. The third-party media may be provided in any manner. For example, the third-party media may be streamed from a streaming service, stored on local memory, cast from a third-party device (such as a user's mobile device), any other source, and combinations thereof. In some embodiments, the media audio stream may be unrelated to the exercise program. For example, the media audio stream may be unrelated to the program audio stream and/or the program video stream.

The volume control system further includes a volume controller. The volume controller may control the volume of the media audio stream and the program audio stream. In some embodiments, the volume controller may cause the audio of the media audio stream and the program audio stream to be played simultaneously. For example, the volume controller may cause the exercise device to play both the media audio stream and the program audio while the exercise device is implementing the exercise program. This may allow the user to exercise using the exercise program while watching and listening to the third-party media.

In accordance with at least one embodiment of the present disclosure, the volume controller may adjust a relative volume between the media audio and the program audio stream. The relative volume may be a representation of the total volume for the media audio stream and the program audio stream played by the exercise device. For example, a relative volume of 50% may indicate that the media audio stream and the program audio stream both represent an equal share in the total volume played out of the speakers. A relative volume of 70% for the program audio stream may indicate that the program audio stream may represent 70% of the total volume played out of the speakers and the media audio stream may represent 30% of the total volume played out of the speakers. In some embodiments, the relative volume may be based on the maximum decibels played out of the speakers at a particular volume level. In some embodiments, the relative volume may be based on pre-determined volume levels of the program audio stream and the media audio stream.

In some embodiments, the volume controller may set the relative volume based on the pre-determined settings. For example, the exercise program may include pre-determined settings for the program audio stream to prioritize the volume of the exercise program over the third-party media. In some examples, the third-party media may include pre-determined settings for the media audio stream to prioritize the volume of the third-party media over the exercise program. In some embodiments, the user may set the relative volume. For example, the user (using a selectable icon, such as the volume icon and/or the media settings menu) may set the relative volume based on the user's preferences. For example, the user may prefer to prioritize the third-party media, allowing the user to focus on the third-party media and not on the exercise program. In some examples, the user may prefer to prioritize the exercise program, allowing the user to focus on the exercise program and not on the third-party media.

In accordance with at least one embodiment of at least one embodiment of the present disclosure, the volume control system may include a content manger. The content manger may adjust the relative volume of the program audio stream and the media audio stream based on content of the exercise program. For example, the exercise program may include content that the volume control system and/or the user may desire to be prioritized. For such priority content, the content manger may alter the relative volume of the program audio stream and the media audio stream. For example, the content manger may cause the program audio stream to receive a higher relative volume than the media audio stream. This may facilitate the user receiving the priority content in the exercise program.

The content manger may alter the relative volume in any manner. For example, the content manger may invert the relative volume (e.g., 70% media audio stream and 30% program audio stream inverted to 30% program audio stream and 30% media audio stream). In some examples, the content manger may increase the relative volume of the program audio stream by a pre-determined amount (e.g., decrease the volume of the media audio stream or increasing the relative volume of the program audio stream 258 by 10%, 20%, 30%, 40%, 50%, 60%, 70%, 80%, 90%, or any value therebetween). In some examples, the content manger may increase the relative volume of the program audio stream to 100% (e.g., mute the media audio stream). In some examples, the content manger may pause the media audio stream.

In some embodiments, the content manger may alter the relative volume based on user input. For example, the user may provide an input (using a selectable icon, such as the volume icon and/or the media settings menu) to determine the amount of alteration to the relative volume by the content manger. In some embodiments, the content manger may alter the relative volume based on manufacturer specifications and/or industry regulations.

The content manger may alter the relative volume based on content in the exercise program. The content in the exercise program may include any content. For example, the content in the exercise program may include a change in one or more exercise parameters of the exercise device. In some examples, the content in the exercise program may include a change in exercise type (e.g., stepping off the exercise device to perform a different exercise, transition to a second exercise device). In some examples, the content in the exercise program may include trainer dialog in the program audio stream. In some examples, the content in the exercise program may include a particular image or video stream in the program video stream.

In some examples, the content of the exercise program that causes the content manger to alter the relative volume may include a metadata tag stored in metadata for the exercise program. For example, the metadata tag may be included in a separate metadata file. In some examples, the metadata tag may be included in the control stream. In some examples, the metadata tag may be included in the program video stream. In some embodiments, the metadata tag may include an instruction to the content manger to alter the relative volume. The metadata tag may be synchronized to a particular time in the exercise program. For example, the metadata tag may be associated with a particular time of the exercise program and the content of the control stream, the program audio stream, the program video stream, and combinations thereof.

In some examples, the metadata tag may include an urgency. The urgency may be a representation of the priority of the change in relative volume. For example, the content manger may include an urgency threshold to adjust the relative volume. The urgency threshold may be based on user preferences, manufacturer standards, industry standards or regulations, and so forth. If the urgency of the metadata tag exceeds the urgency threshold then the content manger may alter the relative volume of the program audio stream and the media audio stream. In some embodiments, the urgency of the metadata tag may be associated with the extent of the change in the relative volume. For example, a lower urgency may be associated with a lower change in the relative volume. A higher urgency may be associated with a higher change in the relative volume. This may prioritize higher urgency content in the exercise program. In some embodiments, the user may change the urgency threshold and/or the change in relative volume for a particular content urgency.

The following text, and the examples provide a number of different methods, systems, devices, and computer-readable media of the volume control system discussed herein. In addition to the foregoing, one or more embodiments can also be described in terms of flowcharts comprising acts for accomplishing a particular result, as discussed herein. The methods discussed herein may be performed with more or fewer acts. Further, the acts may be performed in differing orders. Additionally, the acts described herein may be repeated or performed in parallel with one another or parallel with different instances of the same or similar acts.

As mentioned, the methods described herein describe acts according to one embodiment, alternative embodiments may omit, add to, reorder, and/or modify any of the acts discussed herein. The acts described herein can be performed as part of a method. Alternatively, a computer-readable medium can comprise instructions that, when executed by one or more processors, cause a computing device to perform the acts described herein. In some embodiments, a system can perform the acts described herein.

A volume control system may receive and play a program audio stream at an exercise device. The program audio stream may be played with a program volume. The program volume may be the absolute volume of the program audio stream as heard by the user. The program audio stream is part of an exercise program. The exercise program includes exercise device controls that adjust an operating parameter of the exercise device. The program audio stream is synchronized with the exercise device controls.

The volume control system may receive and play a media audio stream at the exercise device. The media audio stream is played with a media volume. The media volume may be the absolute volume of the media audio stream as heard by the user. Based on a content of the exercise program, the volume control system adjust a relative volume of the program audio stream to emphasize the program audio stream. The relative volume may be the ratio of the program volume to the media volume, or the percentage of the program volume and the percentage of the media volume relative to the total volume played from the speakers of the exercise device. In some examples, emphasizing the program audio stream may include increasing the relative volume of the program audio stream (e.g., increasing the relative volume of the program volume). In some examples, emphasizing the program audio stream may include decreasing the relative volume of the media audio stream (e.g., decreasing the relative volume of the media volume).

An exercise device may implement an exercise program on the exercise device. The exercise program includes exercise device controls that adjust an operating parameter of the exercise device. The exercise program further includes a program video stream and a program audio stream. The program video stream and the program audio stream are synchronized with the exercise device controls. The program audio stream is played through speakers on the exercise device. The exercise device may present third-party media on the exercise device. The exercise device may display, on a display of the exercise device, a media video stream of the third-party media and media audio stream through the speakers of the device. When the exercise program reaches a priority content of the exercise program, a volume control system may alter a relative volume of the media audio stream. In some embodiments, at the priority content, the volume control system may suppress the media video stream, such as by pausing the media video stream and/or overlaying a notice, notification, or a portion of the program video stream over the media video stream.

An exercise device may implement an exercise program on the exercise device. The exercise program includes a video portion and a program media stream. The video portion is displayed on a display of the exercise device and the program media stream is played on a speaker of the exercise device. While displaying the video portion on the display and playing the program media stream on the speaker of the exercise device, the exercise device receives a selection of a selectable icon overlaid over the video portion on the display. Based on the selection, and while implementing the exercise program, a volume control system replaces the video portion on the display with a media video portion of a third party media and plays a media video stream simultaneously with the program media stream. This may facilitate improved control over the exercise device and reduced disruptions to the exercise program when implementing the exercise program.

The selection may be any type of selection. For example, the selection may be a volume selection of a volume selectable icon. This may change a relative volume of the media video stream based on the volume selection. In some examples, the selection may be a control selectable icon overlaid over the media video stream. In some examples, the control selection may adjust at least one operating parameter of the exercise device. In some embodiments, the display includes a picture-in-a-picture icon of the video portion over the media video portion displayed on the display.

One or more computer systems may be used to implement the various devices, components, and systems described herein. The computer system includes a processor. The processor may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU).

Although just a single processor is discussed herein, in an alternative configuration, a combination of processors (e.g., an ARM and DSP) could be used.

The computer system also includes memory in electronic communication with the processor. The memory may be any electronic component capable of storing electronic information. For example, the memory may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into text, graphics, and/or moving images (as appropriate) shown on the display device.

The various components of the computer system may be coupled together by one or more buses, which may include a power bus, a control signal bus, a status signal bus, a data bus, etc. For the sake of clarity, the various buses are discussed herein as a bus system.

Following are sections in accordance with at least one embodiment of the present disclosure:

A1. A method implemented on an exercise device, the method comprising:

receiving and playing a program audio stream at the exercise device, the program audio stream played with a program volume, wherein the program audio stream is part of an exercise program, the exercise program including exercise device controls that adjust an operating parameter of the exercise device, the program audio stream synchronized with the exercise device controls;

receiving and playing a media audio stream at the exercise device, the media audio stream played with a media volume; and based on a content of the exercise program, adjusting a relative volume of the program audio stream to emphasize the program audio stream.

A2. The method of section A1, wherein the media audio stream is unrelated to the exercise program.

A3. The method of any of sections A1 or A2, wherein adjusting the relative volume of the program audio stream includes decreasing a volume of the media audio stream.

A4. The method of section A3, wherein decreasing the volume of the media audio stream includes muting the media audio stream.

A5. The method of section A4, wherein muting the media audio stream includes pausing the media audio stream.

A6. The method of any of sections A1-A5, further comprising, based on a content of the media audio stream, adjusting a relative volume of the media audio stream.

A7. The method of any of sections A1-A6, wherein the content of the exercise program includes a change in one or more exercise parameters.

A8. The method of any of sections A1-A7, wherein the content of the exercise program includes a change in an exercise type.

A9. The method of any of sections A1-A8, wherein the content of the exercise program includes a metadata tag stored in metadata for the program audio stream.

A10. The method of section A9, wherein the metadata tag includes an urgency, and wherein, adjusting the relative volume includes adjusting the relative volume when the urgency is above an urgency threshold.

A11. The method of any of sections A1-A10, wherein the content of the exercise program includes dialog by a trainer.

A12. The method of any of sections A1-A11, wherein the content of the exercise program includes an image or video portion in a video portion of the exercise program.

B1. A method implemented on an exercise device, the method comprising:

implementing an exercise program, the exercise program including exercise device controls that adjust an operating parameter of the exercise device, a program video stream, and a program audio stream, the program video stream and the program audio stream synchronized with the exercise device controls, the program audio stream played through speakers on the exercise device;

presenting third-party media on the exercise device, including displaying, on a display of the exercise device, a media video stream of the third-party media and a media audio stream through the speakers; and when the exercise program reaches a priority content, altering a relative volume of the media audio stream.

B2. The method of section B1, wherein the priority content is based on a change in the exercise device controls.

B3. The method of any of sections B1 or B2, wherein the priority content is based on an urgency in metadata for the exercise program.

B4. The method of any of sections B1-B3, wherein altering the relative volume includes reducing a media volume of the media audio stream and increasing a program volume of the program audio stream.

B5. The method of any of sections B1-B4, further comprising, at the priority content, suppressing the media video stream.

B6. The method of any of sections B1-B5, wherein suppressing the media video stream includes pausing the media video stream and the media audio stream.

C1. A method for operating an exercise device, the method comprising:

implementing an exercise program on the exercise device, the exercise program including a video portion and a program media stream, the video portion displayed on a display of the exercise device and the program media stream played on a speaker of the exercise device;

while displaying the video portion on the display and playing the program media stream on the speaker of the exercise device, receiving a selection of a selectable icon overlaid over the video portion on the display; and based on the selection, and while implementing the exercise program, replacing the video portion on the display with a media video portion of a third party media and playing a media video stream simultaneously with the program media stream.

C2. The method of section C1, further comprising receiving a volume selection of a volume selectable icon and changing a relative volume of the media video stream based on the volume selection.

C3. The method of any of sections C1 or C2, further comprising presenting a control selectable icon overlaid over the media video stream.

C4. The method of section C3, further comprising:

receiving a control selection of the control selectable icon; and based on the control selection, adjusting at least one operating parameter of the exercise device.

C5. The method of any of sections C1-C4, further comprising presenting a picture-in-a-picture icon of the video portion over the media video portion displayed on the display.

Embodiments of the present disclosure may thus utilize a special purpose or general-purpose computing system including computer hardware, such as, for example, one or more processors and system memory. Embodiments within the scope of the present disclosure also include physical and other computer-readable media for carrying or storing computer-executable instructions and/or data structures, including applications, tables, data, libraries, or other modules used to execute particular functions or direct selection or execution of other modules. Such computer-readable media can be any available media that can be accessed by a general purpose or special purpose computer system. Computer-readable media that store computer-executable instructions (or software instructions) are physical storage media. Computer-readable media that carry computer-executable instructions are transmission media. Thus, by way of example, and not limitation, embodiments of the present disclosure can include at least two distinctly different kinds of computer-readable media, namely physical storage media or transmission media. Combinations of physical storage media and transmission media should also be included within the scope of computer-readable media.

Both physical storage media and transmission media may be used temporarily store or carry, software instructions in the form of computer readable program code that allows performance of embodiments of the present disclosure. Physical storage media may further be used to persistently or permanently store such software instructions. Examples of physical storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored as or in software, hardware, firmware, or combinations thereof.

A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instructions or data structures and which can be accessed by a general purpose or special purpose computer.

Further, upon reaching various computer system components, program code in the form of computer-executable instructions or data structures can be transferred automatically or manually from transmission media to physical storage media (or vice versa). For example, computer-executable instructions or data structures received over a network or data link can be buffered in memory (e.g., RAM) within a network interface module (NIC), and then eventually transferred to computer system RAM and/or to less volatile physical storage media at a computer system. Thus, it should be understood that physical storage media can be included in computer system components that also (or even primarily) utilize transmission media.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method implemented on an exercise device, the method comprising:

playing, at the exercise device, a program audio stream of an exercise program package, the program audio stream played with a program volume, the exercise program package including exercise device controls that adjust an operating parameter of the exercise device, and wherein the program audio stream is synchronized with the exercise device controls;

receiving and playing a media audio stream at the exercise device, the media audio stream played with a media volume; and based on a content of the exercise program package, adjusting a relative volume of the program audio relative to the media volume to emphasize the program audio stream.

2. The method of claim 1, wherein the media audio stream is unrelated to the exercise program package.

3. The method of claim 1, wherein adjusting the relative volume of the program audio stream includes decreasing a volume of the media audio stream.

4. The method of claim 3, wherein decreasing the volume of the media audio stream includes muting the media audio stream.

5. The method of claim 4, wherein muting the media audio stream includes pausing the media audio stream.

6. The method of claim 1, further comprising, based on a content of the media audio stream, adjusting a relative volume of the media audio stream.

7. The method of claim 1, wherein the content of the exercise program package includes a change in one or more exercise parameters.

8. The method of claim 1, wherein the content of the exercise program package includes a change in an exercise type.

9. The method of claim 1, wherein the content of the exercise program package includes a metadata tag stored in metadata for the program audio stream.

10. The method of claim 9, wherein the metadata tag includes an urgency, and wherein, adjusting the relative volume includes adjusting the relative volume when the urgency is above an urgency threshold.

11. The method of claim 1, wherein the content of the exercise program package includes dialog by a trainer.

12. The method of claim 1, wherein the content of the exercise program package includes an image or video portion in a video portion of the exercise program package.

13. A method implemented on an exercise device, the method comprising:

implementing an exercise program package, the exercise program package including exercise device controls that adjust an operating parameter of the exercise device, a program video stream, and a program audio stream, the program video stream and the program audio stream synchronized with the exercise device controls, the program audio stream played through speakers on the exercise device;

presenting third-party media on the exercise device, including displaying, on a display of the exercise device, a media video stream of the third-party media and a media audio stream through the speakers; and when the exercise program package reaches a priority content, altering a relative volume of the media audio stream.

14. The method of claim 13, wherein the priority content is based on a change in the exercise device controls.

15. The method of claim 13, wherein the priority content is based on an urgency in metadata for the exercise program package.

16. The method of claim 13, wherein altering the relative volume includes reducing a media volume of the media audio stream and increasing a program volume of the program audio stream.

17. The method of claim 13, further comprising, at the priority content, suppressing the media video stream.

18. The method of claim 17, wherein suppressing the media video stream includes pausing the media video stream and the media audio stream.

19. A method for operating an exercise device, the method comprising:

implementing an exercise program package on the exercise device, the exercise program package including a video portion and a program media stream, the video portion displayed on a display of the exercise device and the program media stream played on a speaker of the exercise device;

while displaying the video portion on the display and playing the program media stream on the speaker of the exercise device, receiving a selection of a selectable icon overlaid over the video portion on the display; and based on the selection, and while implementing the exercise program package, replacing the video portion on the display with a media video portion of a third party media and playing a media video stream simultaneously with the program media stream.

20. The method of claim 19, further comprising receiving a volume selection of a volume selectable icon and changing a relative volume of the media video stream based on the volume selection.

* * * * *